US010955211B1

(12) United States Patent
Alber et al.

(10) Patent No.: US 10,955,211 B1
(45) Date of Patent: Mar. 23, 2021

(54) LOCK SYSTEM

(71) Applicants: Wilfried Alber, Volkach (DE); Georg Holthaus, Kitzingen (DE)

(72) Inventors: Wilfried Alber, Volkach (DE); Georg Holthaus, Kitzingen (DE)

( * ) Notice: Subject to any disclaimer, the term of this patent is extended or adjusted under 35 U.S.C. 154(b) by 0 days.

(21) Appl. No.: 16/747,301

(22) Filed: Jan. 20, 2020

(30) Foreign Application Priority Data

Sep. 12, 2019 (DE) ..... 10 2019 124 569.9

(51) Int. Cl.
*F41A 17/74* (2006.01)

(52) U.S. Cl.
CPC ..... *F41A 17/74* (2013.01)

(58) Field of Classification Search
CPC ..... F41A 17/74
USPC ..... 42/70.08
See application file for complete search history.

(56) References Cited

U.S. PATENT DOCUMENTS 2,509,640 A 5/1950 Higson
4,575,963 A * 3/1986 Ruger ..... F41A 17/72 42/70.08
5,225,611 A * 7/1993 Scott ..... F41A 19/23 42/42.03
5,267,407 A * 12/1993 Bornancini ..... F41A 17/30 42/70.08
2017/0234639 A1* 8/2017 Kuracina ..... F41C 3/00 89/128

FOREIGN PATENT DOCUMENTS

DE 297 15 238 U1 10/1997
EP 0 855 569 A1 7/1998
GB 191506875 A 8/1916
WO WO-2008/086545 A1 7/2008

OTHER PUBLICATIONS

Office Action dated Jun. 30, 2020 in German Application No. 10 2019 124 569.9.

* cited by examiner

*Primary Examiner* — Samir Abdosh
(74) *Attorney, Agent, or Firm* — Saliwanchik, Lloyd & Eisenschenk

(57) ABSTRACT

The invention relates to a lock system for a firearm having an arrangement composed of at least two lever arms; in a manner similar to a toggle lever, the lever arms are connected to an axle or shaft in articulating fashion; the resulting toggle lever can be pivoted to both sides of a dead point in which the arrangement is maximally extended; and one of the lever arms is embodied as a hammer for a firing pin.

23 Claims, 17 Drawing Sheets

LOCK SYSTEM

CROSS-REFERENCE TO RELATED APPLICATION

This application claims priority to German Application No. 10 2019 124 569.9, filed Sep. 12, 2019; which is hereby incorporated by reference in its entirety.

The invention relates to a lock system for a firearm according to the preamble to claim 1.

In the following, the lock system for a firearm should be understood to mean the system of functional components that are used for firing including the components used for securing the system and in particular for temporarily immobilizing the components used for the firing.

Firearms are provided with different lock systems depending on the design.

In so-called break-action weapons, there are blitz locks, boxlocks, and sidelocks. By tilting the barrels of a break-action weapon, for example of a shotgun, a break-action rifle, a double rifle, or a drilling, the locks are cocked, i.e. a hammer is moved in opposition to the spring force of a mainspring into a non-released spring-loaded position and immobilized there with a latch. With the aid of the trigger, this latched position can be released so that the hammer, under the pressure of a mainspring, comes into contact with a firing pin, which emerges from a firing pin opening and crushes the primer of a cartridge, thus igniting it.

In rotating bolt breeches of bolt-action rifles, basically the firing pin itself is brought into or is in an operative connection with the mainspring and upon the opening (or in rare cases also upon the closing) of the breech and thus upon the locking of the chamber in the barrel or in a receiver head, the mainspring is cocked. Usually, at an axial end of the chamber opposite from the cartridge chamber, there is a firing pin nut, which moves rearward during the opening or closing of the breech, thus cocking the mainspring. When the bolt is slid into the receiver in which the rotating bolt breech is supported in an axially movable way, the firing pin nut is axially blocked by a latch so that the mainspring stays cocked. By actuating the trigger, the latch is usually moved downward so that under the spring force of the mainspring, the firing pin is abruptly moved forward, emerges from the breech face of the chamber, and ignites the cartridge.

In rotating bolt head actions of the kind usually found in semiautomatic firearms and sometimes also fully automatic ones, a hammer is pushed into a latched position by the return of the bolt and is held there by a latch in opposition to the pressure of a mainspring. If the bolt, particularly due to the action of a bolt spring, is forced back into the closed state and is locked to the barrel or a receiver head, then likewise due to the release of the latched connection due to the actuation of a trigger, the hammer can pivot forward in the direction of the firing pin and can strike the firing pin; thus in a rotating bolt head action, the firing pin is supported in spring-loaded fashion inside the rotating bolt head action and when struck from behind by the hammer, likewise shoots forward out of the breech face and by means of the primer, ignites a cartridge.

The lock can thus be an integral component of the bolt, as in rotating bolt breeches of bolt-action rifles (in which the firing pin nut is sometimes also referred to as the cocking piece), but, as in break-action weapons, can also be functionally separate from the actual bolt.

In the following, the lock is understood to be the functional unit that cooperates for the firing and also includes a safety.

Particularly in weapons that have a rotating bolt head action—such as so-called straight-pull bolt-action rifles, semiautomatic or fully automatic firearms or rifles—the design is dictated by the functions.

Firearms of this kind have a barrel for directing the bullet and also for ensuring development of the gas pressure; a bolt that tightly seals the barrel toward the rear at the moment of firing and that holds the cartridge in place; a magazine or other cartridge supply region from which the bolt, in the movement toward the barrel in order to close the latter, slides a cartridge and inserts it into the cartridge chamber of the barrel before it seals the cartridge chamber toward the rear; and the lock, which includes the hammer, usually a sear bar or a comparable component, and the trigger. On the hammer and the sear bar, the latch and the latch counterpart are provided, which in the cocked state of the hammer and thus of the lock, cooperate to hold back the hammer. The mainspring is also present, which holds the hammer in the cocked state with a prestressing force in order to enable a very rapid movement toward the firing pin.

In small arms, a shoulder piece is usually attached in order to be able to pull the weapon into the shoulder when firing in order on the one hand, to enable precise targeting and on the other, to enable absorption of the recoil.

This predetermined sequence of functional parts dictates a minimum length at least between the cartridge chamber, magazine well, lock, and stock attachment depending on the design.

Conventional locks can be equipped with a wide variety of safeties. The safest is the so-called firing pin safety because it inhibits the last functional component before the primer of the cartridge from moving, even if the lock is inadvertently released. There is also the so-called transfer bar safety, which secures the sear bar so that if the trigger is inadvertently released, the sear bar is not moved and thus the latch of the sear bar and the latch counterpart of the hammer or firing pin nut do not disengage. The transfer bar safety is less safe than the firing pin safety simply because it does not rule out the possibility—due to external influences such as a fall or drop—of the latched connection nevertheless being released and the hammer coming into contact with the firing pin and firing a shot.

A third known safety is the trigger safety in which only the trigger tongue is prevented inhibited from moving so that an inadvertent pressure on the trigger tongue does not move the sear bar. This safety has an even lower safety potential compared to the two safeties mentioned above since the mechanical chain of the sear bar and hammer or firing pin nut is not secured in this case and can likewise be released due to shock or impact.

In order to render such latch-securing safety systems obsolete, so-called manual cocking systems were developed, in particular by the Blaser company, in which the mainspring is cocked before firing, while the latched connection between the hammer and sear bar or between the firing pin nut and sear bar already exists, but the entire system is not triggered even if the trigger is actuated because the firing pin spring lacks the force. Such systems are touted and described as being safer than systems with a manual safety, but strictly speaking, this is not correct. If after a first firing or after having decided not to shoot, the shooter forgets to move the manual cocking slider back into the initial position, then the system is fully cocked and its safety is entirely off. For purposes of accident prevention, it is thus a system that is in no way safer than a manual safety system and depending on the shooter, is even much less safe.

The object of the invention is to create a lock system, which makes it possible to produce a firearm with a shorter overall length, has an improved safety, and is also rugged and hard-wearing.

The object is attained with a lock system having the features of claim 1.

Advantageous modifications are disclosed in the dependent claims that are dependent on it.

Whenever the "front" is spoken of below in connection with a firearm, this specifically means forward in the direction of fire, i.e. closer when viewed from the muzzle.

Whenever the "rear" or "rearward" is spoken of in the following, this means in the direction away from the direction of fire or farther away from the muzzle.

Whenever "above" or "upper" are spoken of in the following, this means the side of the weapon that is oriented upward in the conventional shooting stance. This is normally the side of a weapon, which, in the conventional shooting stance, has aiming aids such as a rifle scope or sights, or the notch and bead, i.e. the sight line.

Whenever "below" or "lower" are spoken of in the following, in relation to the weapon, this describes the side, which, in the conventional shooting stance, points downward and usually has the pistol grip, the trigger, and the magazine well.

Whenever "lateral" or "side" are spoken of in the following, in relation to the weapon, this means laterally or to the side in the conventional shooting stance, for example like the ejection window for cartridges.

It is clear to the person skilled in the art that this frame of reference also applies when the weapon is held differently, is set down, or is in some other way placed in a different spatial orientation.

The lock system according to the invention is designed so that the components actually required for the firing such as the hammer, mainspring, sear bar, etc. are positioned above a bolt travel path. The bolt travel path in this case is the travel path on which the bolt travels when it is moved rearward out of the position in which it seals the cartridge chamber and then is moved forward again in order to supply a cartridge from a magazine, which has been inserted into the magazine well, to then insert the cartridge into the cartridge chamber and, behind the cartridge chamber, to seal the barrel toward the rear.

According to the invention, the safety mechanism is therefore also relocated from the bottom to the top; both the action of the trigger and the action of a safety slider are mechanically transmitted from the bottom to the top around the bolt, the barrel, and/or a barrel receptacle.

According to the invention, the hammer unit of the lock, i.e. the hammer or a lever arm functioning as the hammer and lever elements connected thereto, is embodied in the form of a toggle lever. If the hammer or the lever is moved into the cocked position and thus cocks the mainspring, a sear bar cooperates in a latching fashion with the hammer or this lever, the sear bar being pressed into the latch by the pressure of a spring.

The invention takes advantage of the fact that a toggle lever has a dead point in the fully extended state. If it is pivoted in the one or the other direction, it assumes a mechanically more stable state from which it can only be brought back through the dead point by an external influence. The toggle lever is the essential feature of the invention.

According to the invention, the safety in this case functions so that the toggle lever mechanism of the hammer and the mechanical parts operatively connected to it are pushed upward opposite from the hammer direction, which is a downward-pivoting motion, and are held there. In other words, the toggle lever is moved upward opposite from the hammer direction through the dead point and remains there in a mechanically stable position. By means of this, not only does the safety rod make sure that the hammer cannot be moved in the direction toward the firing pin because the movement is blocked, but also the special feature of the toggle lever makes sure that whatever force acts on the hammer, it does so in exactly the opposite direction, i.e. away from the firing pin.

Consequently, according to the invention, a particularly reliable safety is achieved, which is far superior to known safety systems and manual cocking systems. The invention achieves the advantage that a simply embodied, rugged lock for a firearm, in particular a bolt-action firearm is achieved, which has a particularly reliable safety and is also very ruggedly built due to the design.

The invention therefore relates to a lock system for a firearm having an arrangement composed of at least two lever arms; the lever arms are connected to a rotation axle or shaft in articulating fashion similar to a toggle lever, the resulting toggle lever being pivotable to both sides of a dead point in which the arrangement is maximally extended and one of the lever arms being embodied as a hammer for a firing pin.

In this connection, it is advantageous if a pivoting direction to a side of the dead point closer to the firing pin defines a released position and a pivot to the other side of the dead point defines a safety position.

It is also preferable if the at least one lever arm acts on the rotation axle under the pressure of a spring so that the dead point must be overcome in opposition to the pressure of the spring.

It is also advantageous if in the released position, a lever with a latch is embodied so that it cooperates in a detachable way with a latch counterpart or surface of a sear bar.

In an advantageous embodiment, the system including the lever arms is positioned on the top of a weapon above a bolt travel path.

Advantageously, in order to transmit a trigger movement of a trigger tongue to a sear bar positioned above the bolt path, a trigger transmission lever is provided, which transmits the movement of a trigger slide, which is positioned on the underside of the weapon, to the top of the weapon; the trigger transmission lever is positioned at a free end diametrically opposite from a free end of the sear bar and is supported there in articulating fashion and toward the underside of the weapon, the trigger transmission lever is likewise supported in articulating fashion in the trigger slide; the trigger transmission lever is guided around the components situated between the top of the weapon and the underside of the weapon and/or around a bolt travel path so that movement of the trigger slide in one axial direction is converted into a movement of the sear bar in the opposite axial direction.

In an advantageous way, in a cocked, unreleased position of the lock, the sear bar, with the underside of a free end, engages in a latch or latch recess in the cylindrical region of the one lever; the underside of one end of the sear bar serves as latch counterpart element for a flat latch surface formed by the recess, which extends transversely, i.e. axially relative to the hammer rotation axle, so that the lock holds the lever arrangement—in opposition to the pressure of a spring—against a hammer bar, which is connected in articulating fashion to the other lever arm and is held by the sear bar when the surface of the sear bar is resting against or on the surface of the lever.

It is also advantageously possible that the sear bar is positioned so that it can move axially into and out of the latched engagement between the surfaces; the sear bar is spring-loaded in the direction toward the engagement so that the release of the latched connection must take place in opposition to the pressure of a spring.

Advantageously, in addition, a safety is provided; the safety comprises a safety rod; and the safety rod has means, which are embodied to cooperate with counterpart means of one of the levers in such a way that to activate the safety, the means pivot a toggle lever arrangement of the hammer arrangement out of the released position through the dead point into the safety position and to deactivate the safety, pivot of the safety position through the dead point into the released position.

In one embodiment of the invention, the lock has a hammer arrangement, which has a hammer and at least one hammer actuating lever arm; the hammer is pivotable around a rotation axle toward and away from a firing pin and at least one hammer actuating lever arm is linked to the hammer by means of a rotation axle; the rotation axle is positioned remote from the rotation axle on the hammer; and the hammer and hammer actuating lever arm form a toggle lever, which can be pivoted around the rotation axle to both sides of a dead point.

In another embodiment of the invention, the safety has two oblique surfaces, which have an inclination oriented in the same direction, and the means on the hammer arrangement is a laterally protruding pin so that by means of the pin sliding along an oblique surface, the hammer arrangement moves through the dead point into the safety position and when the safety rod is moved into the firing position, the oblique surface moves the pin and thus the hammer arrangement out of the safety position, through the dead point, and into the firing position or released position.

It is advantageously also possible that in the safety position, after being pivoted through the dead point, the pin rests against the flute bottom of a flute in the safety rod, which blocks the movement of the pin and thus of the hammer arrangement into the released position.

In one modification, a safety arrangement has a rotation prevention means for a bolt of the firearm; the bolt has a locking pin and the safety rod has a catch, lug, or pocket, which, when the safety is activated, is placed around the safety pin or, in order to block a movement in a rotation direction, rests against the safety pin.

It is also advantageously possible that on the safety rod there is a safety transmission lever in order to transmit the movement of a safety slider, which is positioned on the underside of the weapon, to the safety rod on the top of the weapon; the safety transmission lever is positioned at a free end of the safety rod and on the underside of the weapon, is supported in articulating fashion on the safety slider; and the safety transmission lever is routed around the bolt and/or a cartridge chamber and/or other components or around the bolt travel path and is supported in articulating fashion on the safety slider.

Advantageously, the trigger transmission lever and the safety transmission lever can be embodied as C-shaped, ring-shaped, bracket-shaped, or question mark-shaped.

In one embodiment, the toggle lever arrangement is embodied by means of a hammer lever arm and a guide lever arm; the hammer lever arm is an elongated component, one end of which is connected to a hammer bar, and at its end the hammer lever arm is able to swivel around a rotation axle; the rotation axle cooperates with two cheeks, which are positioned at one end of the hammer bar and embrace the end between themselves, and passes through the end so that the hammer lever arm is able to rotate around the axle.

Advantageously, at a diametrically opposite end of the hammer lever arm, there is an angled hammer surface; spaced apart from the end and from the hammer surface toward the end, there is a guiding rotation shaft, which passes through the hammer lever arm so that the free end of the hammer lever arm, which protrudes beyond the shaft and has the hammer surface, forms the hammer.

It is also advantageous if the hammer lever arm with the guiding rotation shaft is supported in rotating fashion on the guide lever arm; the guide lever arm is a plate-like element with two side surfaces, a top, a bottom, a front end region, and a rear end region; and an accommodating slot for accommodating the hammer lever arm extends from the rear end region to the front end region over a partial length of the guide lever arm.

It is also advantageous if the hammer lever arm and the guide lever arm compose the toggle lever arrangement; the guide lever arm can be pivoted around laterally protruding shaft stubs and the hammer lever arm can be pivoted upward and downward around the shaft and the two are connected to each other by means of the shaft; the toggle lever arrangement composed of the hammer lever arm and the guide lever arm is acted on with spring force by means of the hammer bar and a mainspring positioned around it; and the guide lever arm is affixed to the chassis of a firearm by means of shaft stubs when the hammer lever arm and hammer bar, by means of a pivoting of the toggle lever arrangement, are able to move to a limited degree in a direction opposite from a direction of fire.

It is also advantageous if a recess is provided in the underside of the guide lever arm, extending from the front side; the recess is embodied so that it extends into the guide lever arm; the recess has a recess roof at the top; the recess roof has a front region and a rear region; and the front region and rear region are embodied so that the recess roof has a front recess roof region and a rear recess roof region, which are embodied as inclined relative to each other at an angle, in particular at an angle of 25° to 50°.

In one embodiment, it is advantageous if a safety rod is provided for pivoting the guide lever arm and for activating and deactivating the safety; at one end, the safety rod has a control bead; and the bead is embodied so that it cooperates with the recess and the recess roof in a corresponding fashion.

It can also be advantageous if the toggle lever arrangement composed of the hammer lever arms and guide lever arms is in an activated-safety position when the shaft is positioned above the shaft stubs and is in a deactivated-safety, ready-to-fire position when the shaft or its rotation axis is positioned below the shaft stubs or their rotation axis, and is in a fired position when the rotation shaft or guiding rotation shaft is positioned partially below or entirely below the shaft stubs as a result of which, the hammer bar is positioned the farthest forward in the direction of fire.

The invention will be explained by way of example based on a drawing. In the drawings.

Figure 3:
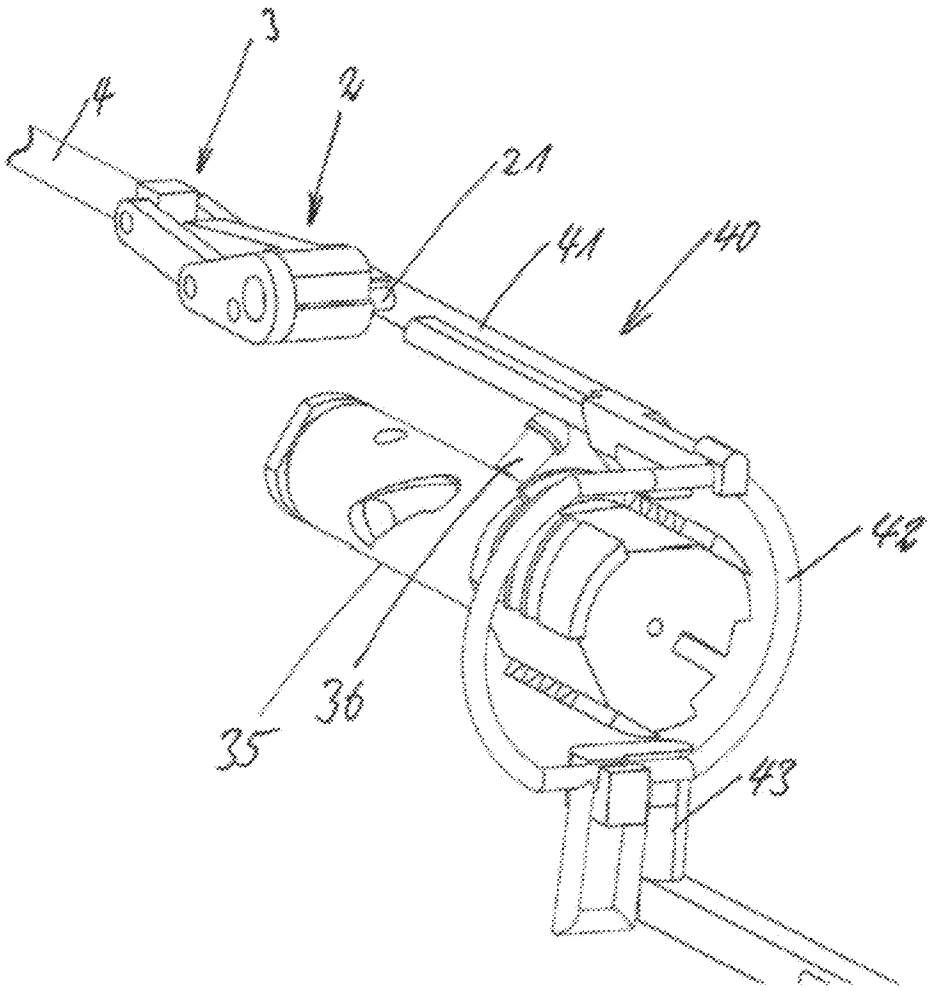
Figure 4:
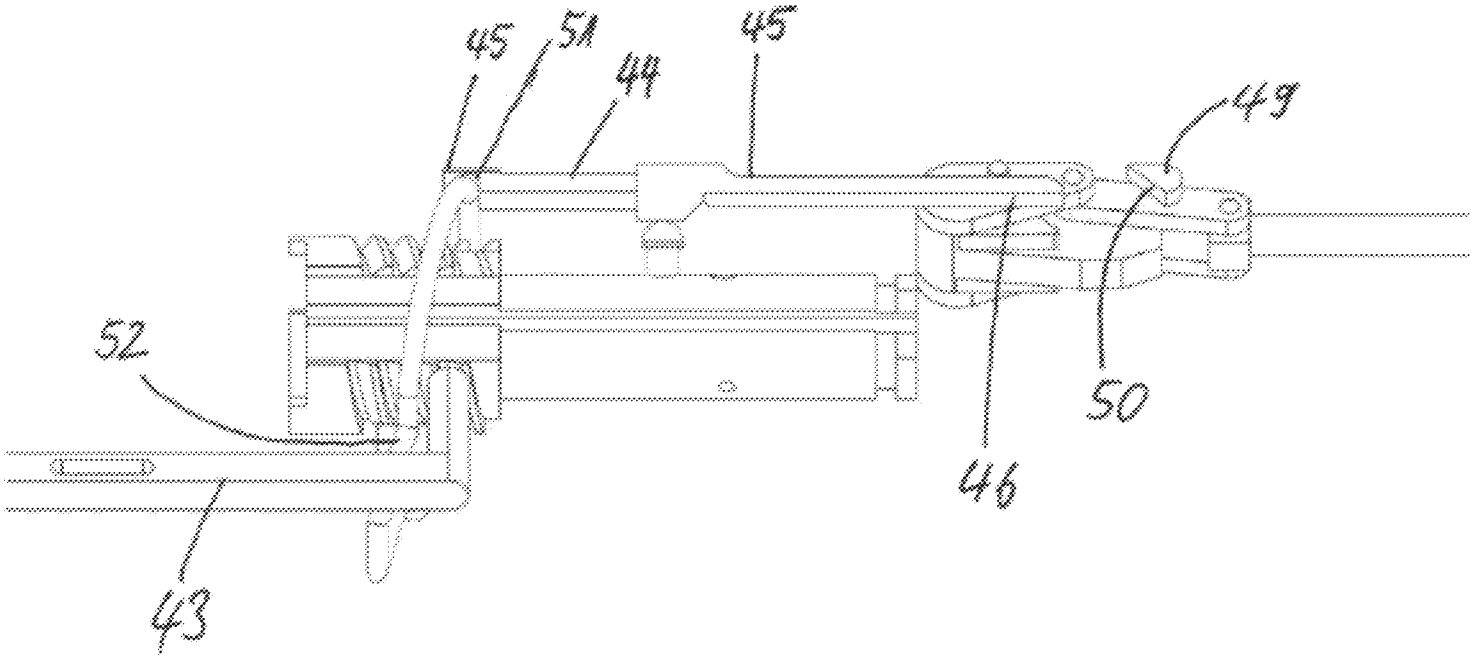
Figure 5:
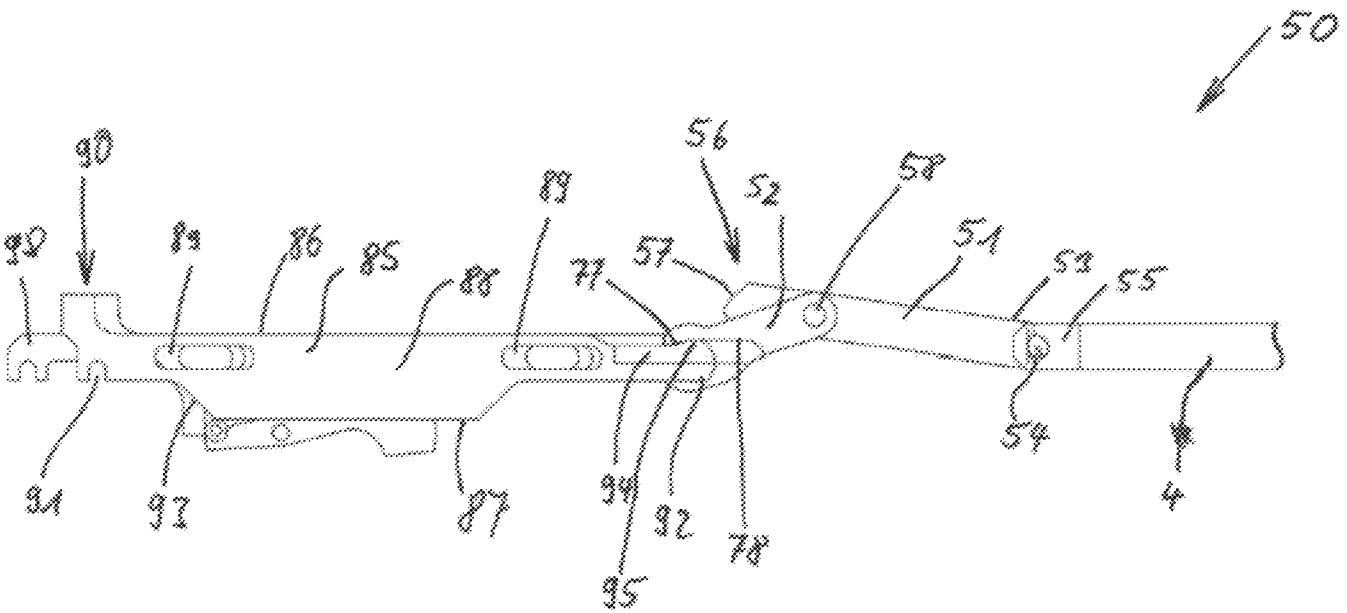
Figure 6:
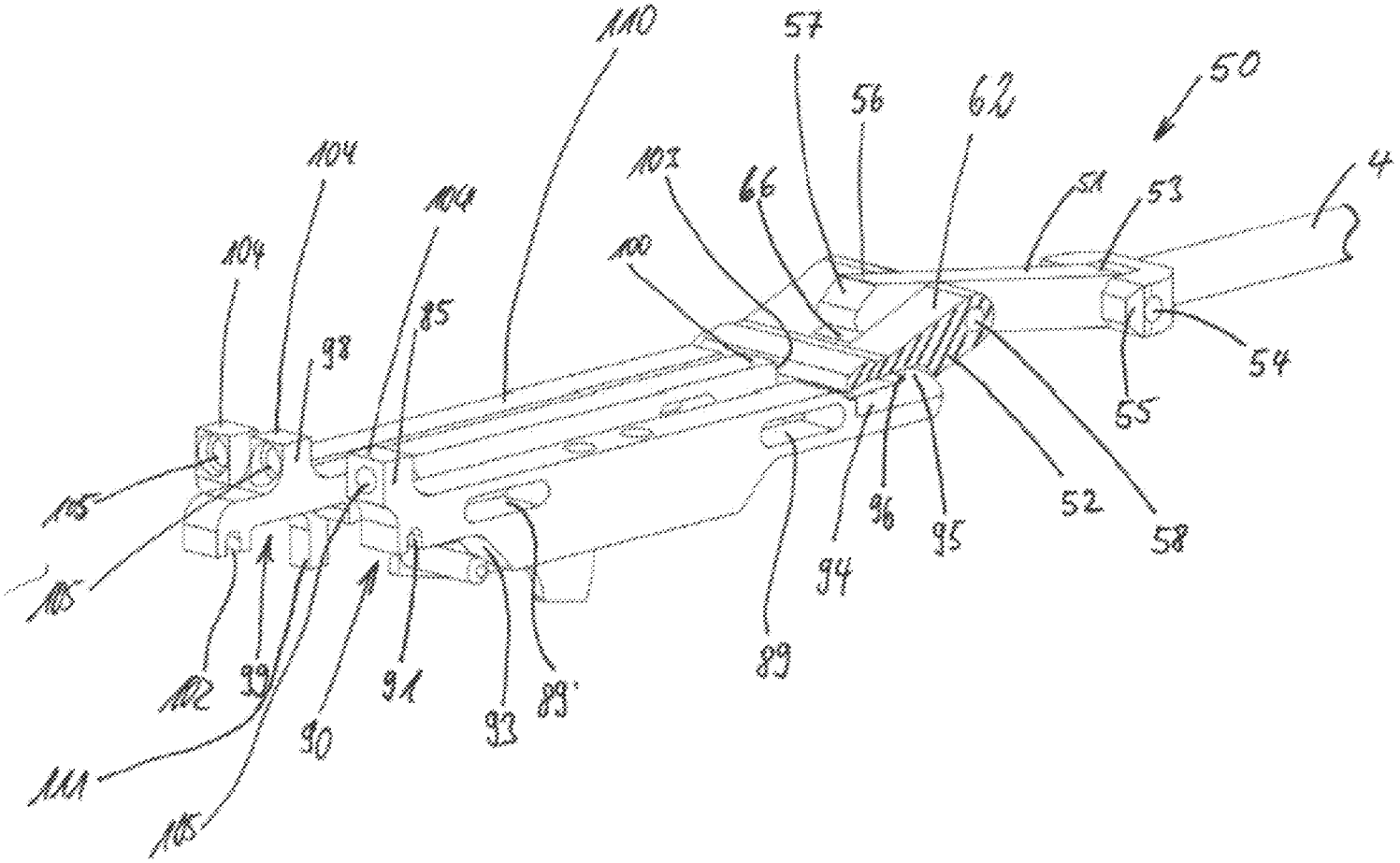
Figure 7:
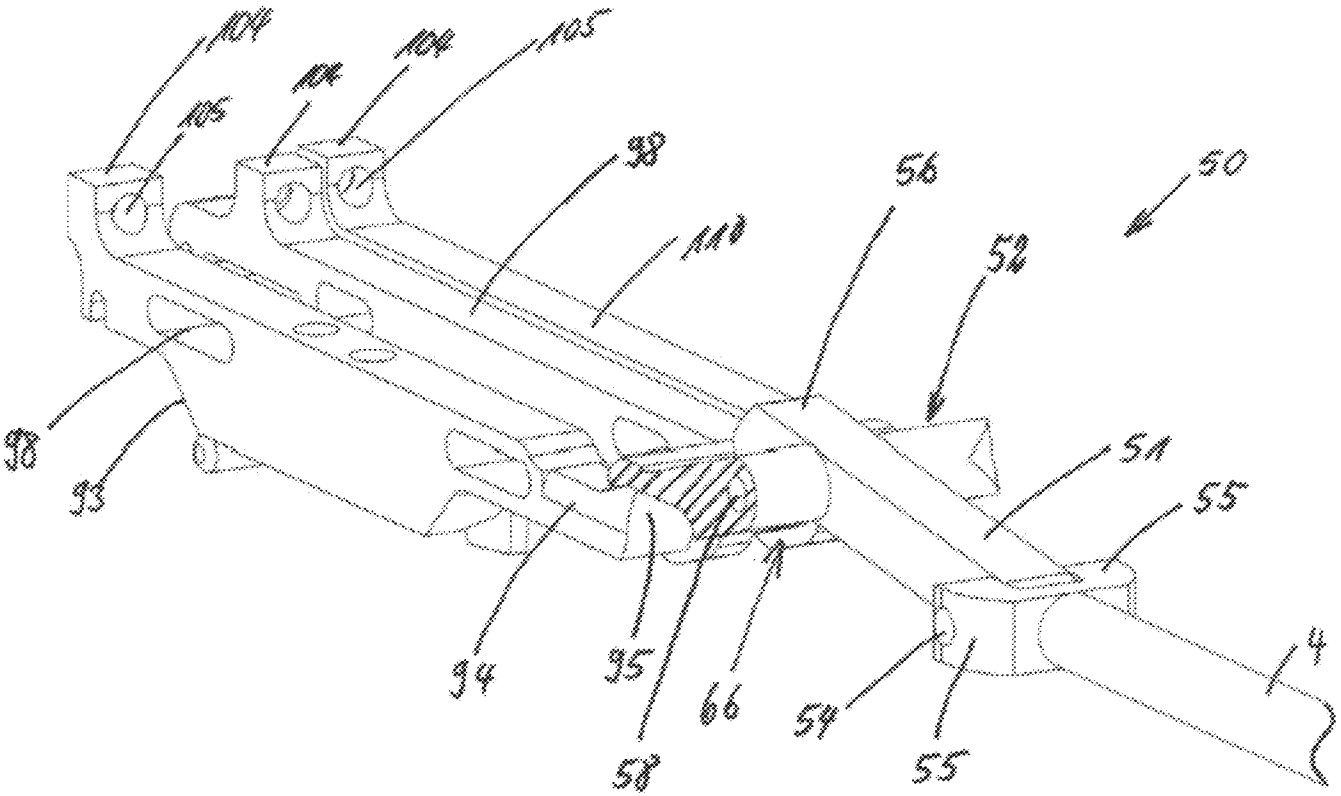
Figure 8:
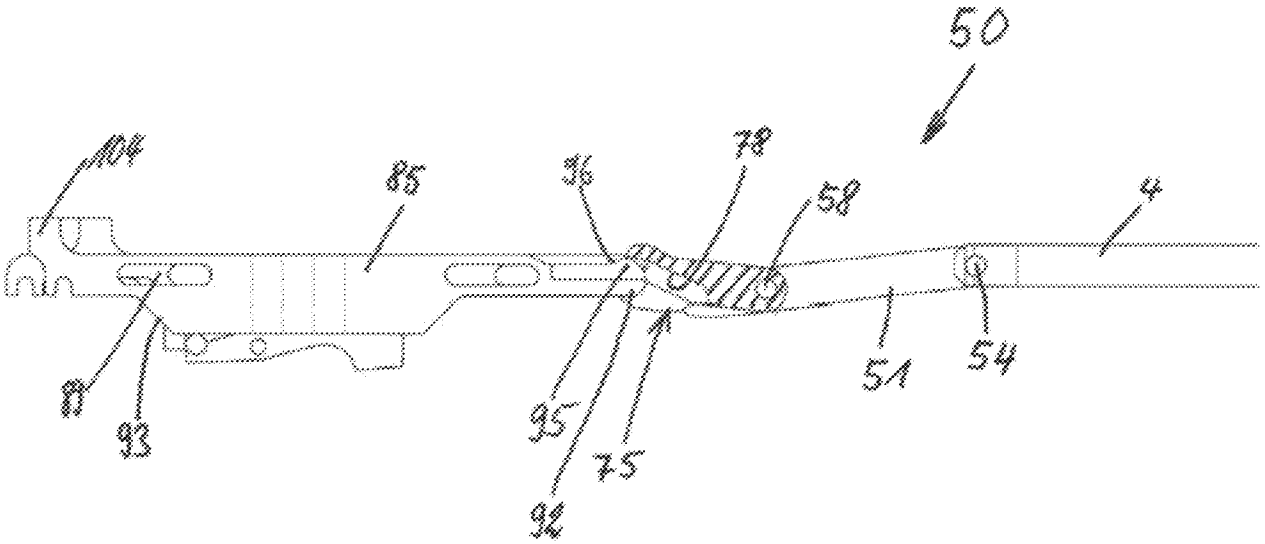
Figure 9:
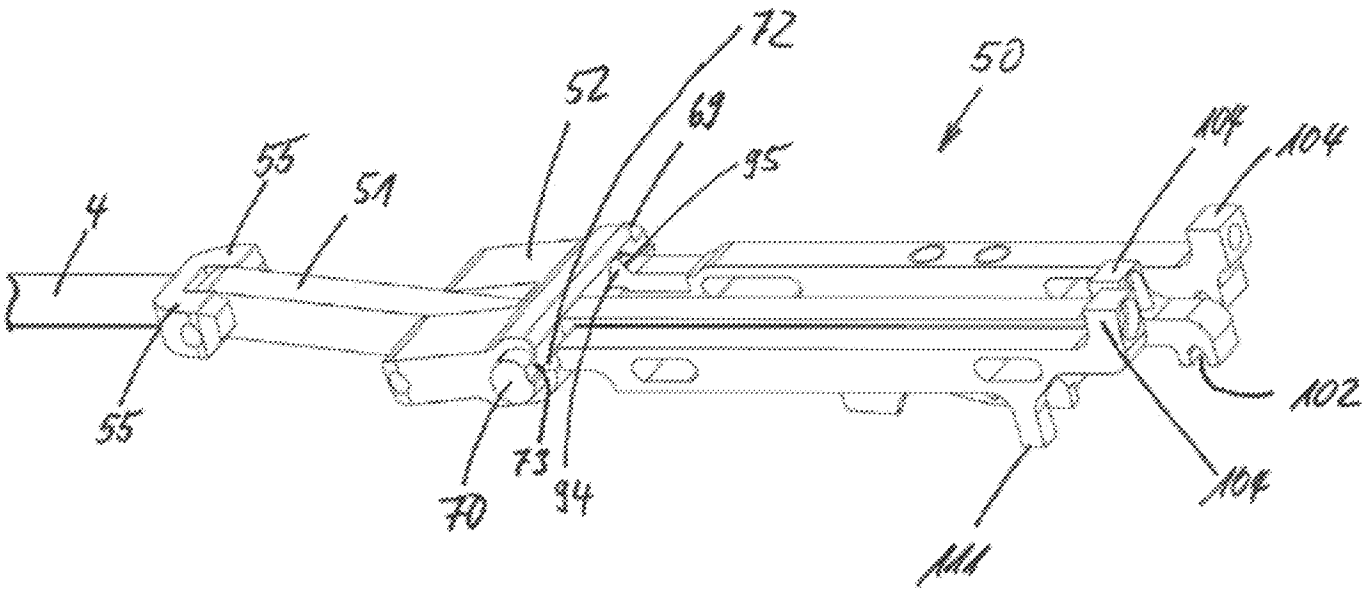
Figure 10:
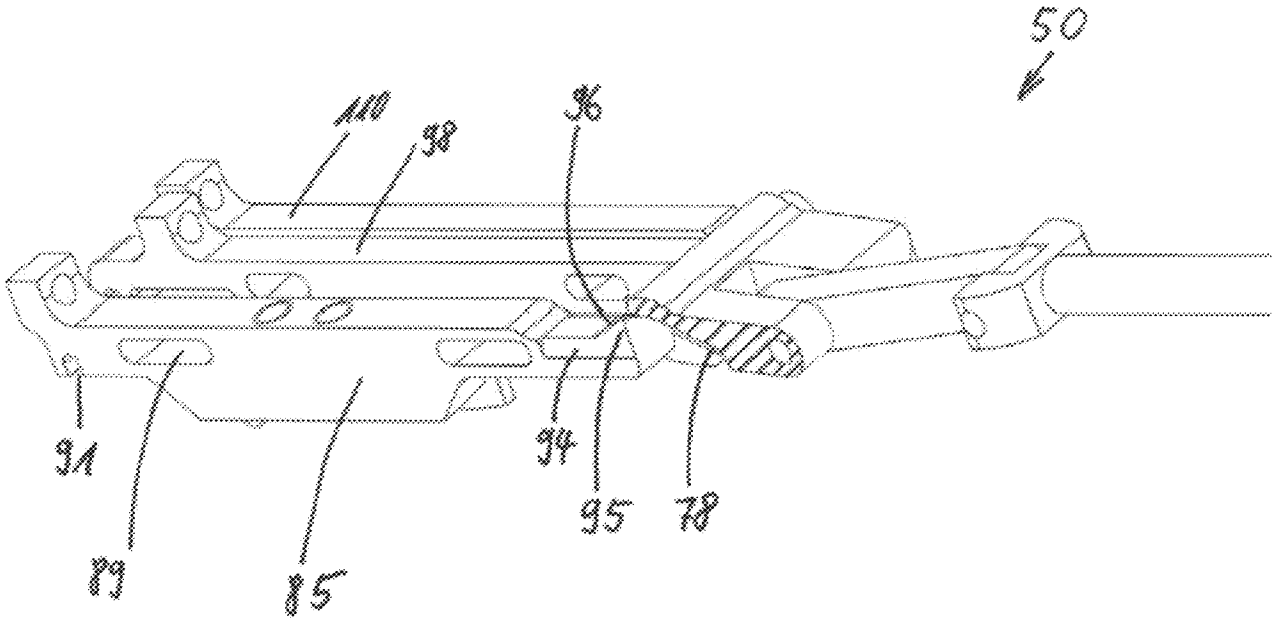
Figure 11:
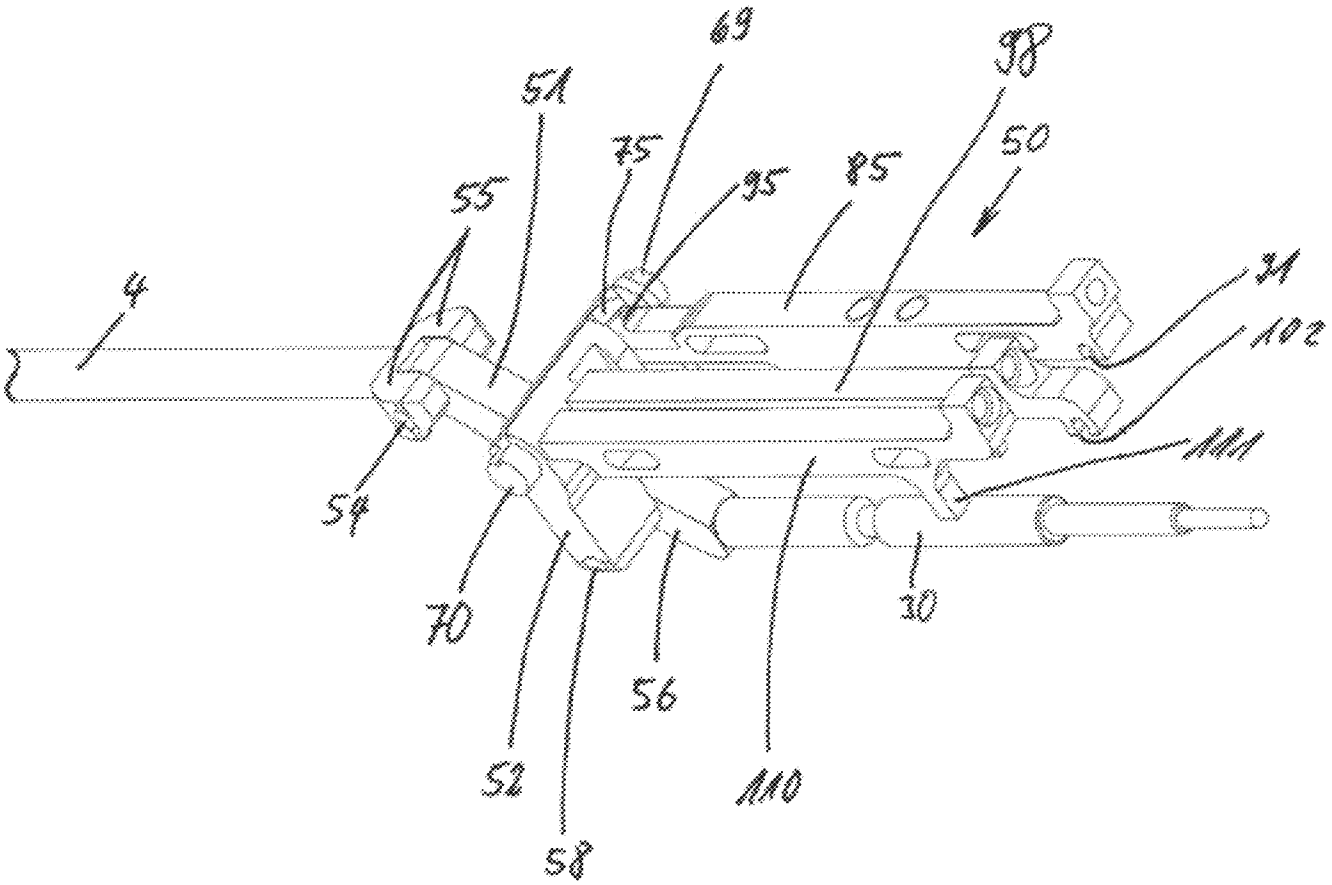
Figure 12:
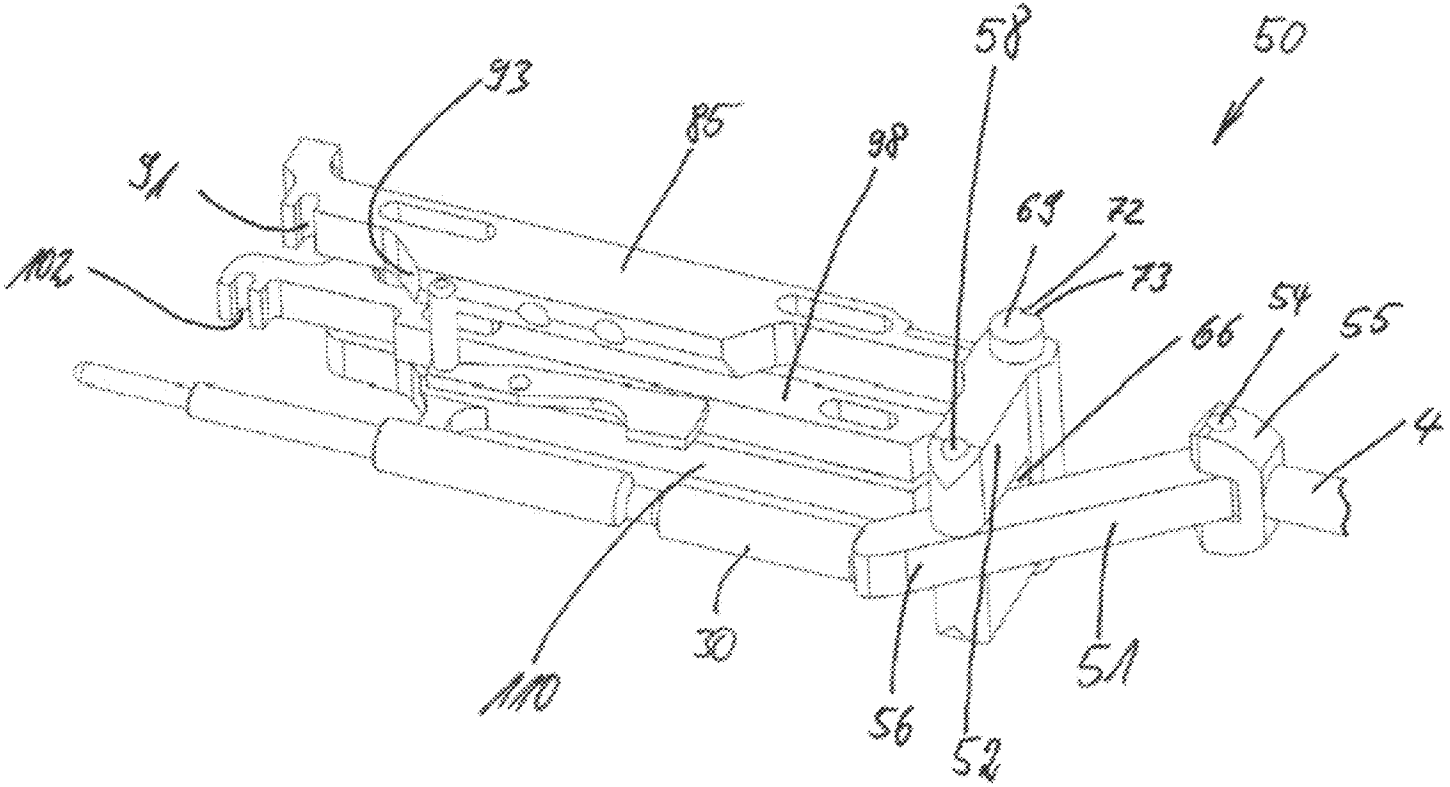
Figure 13:
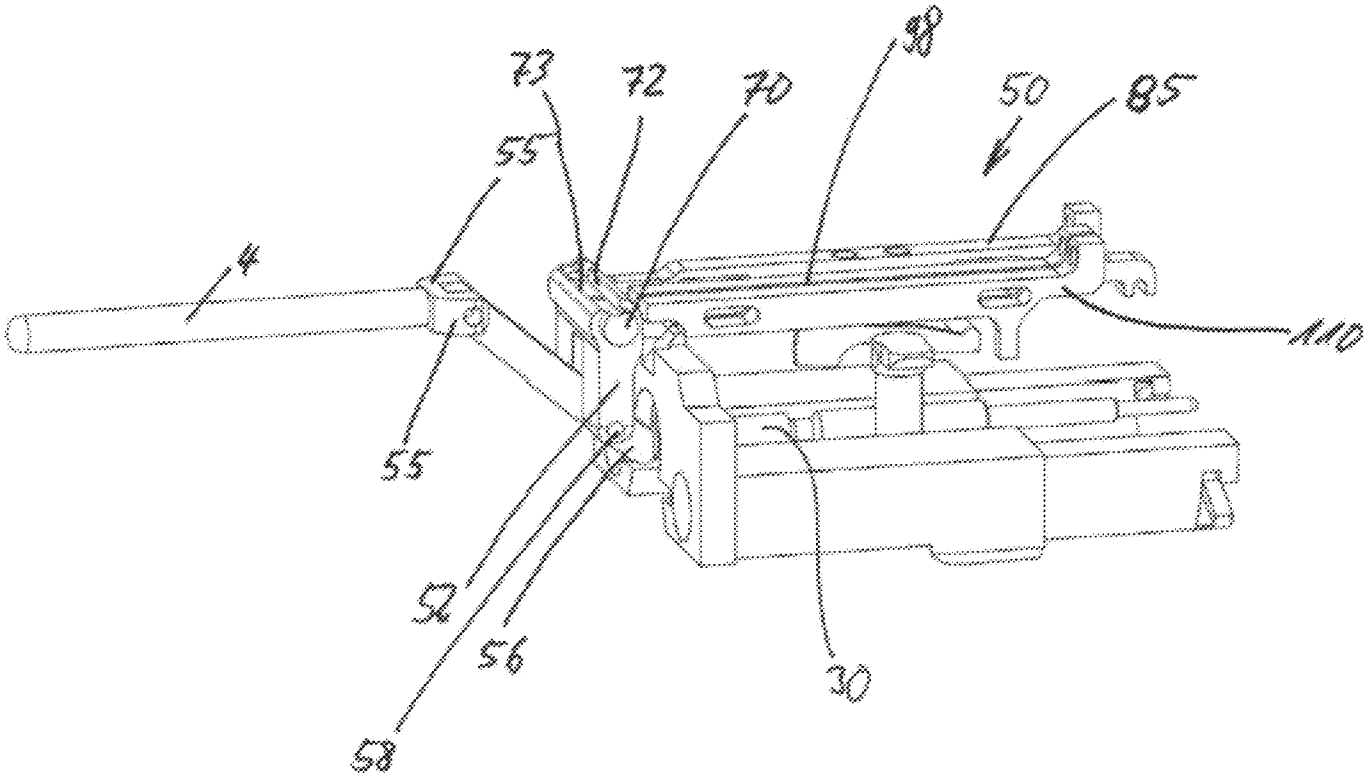
Figure 14:
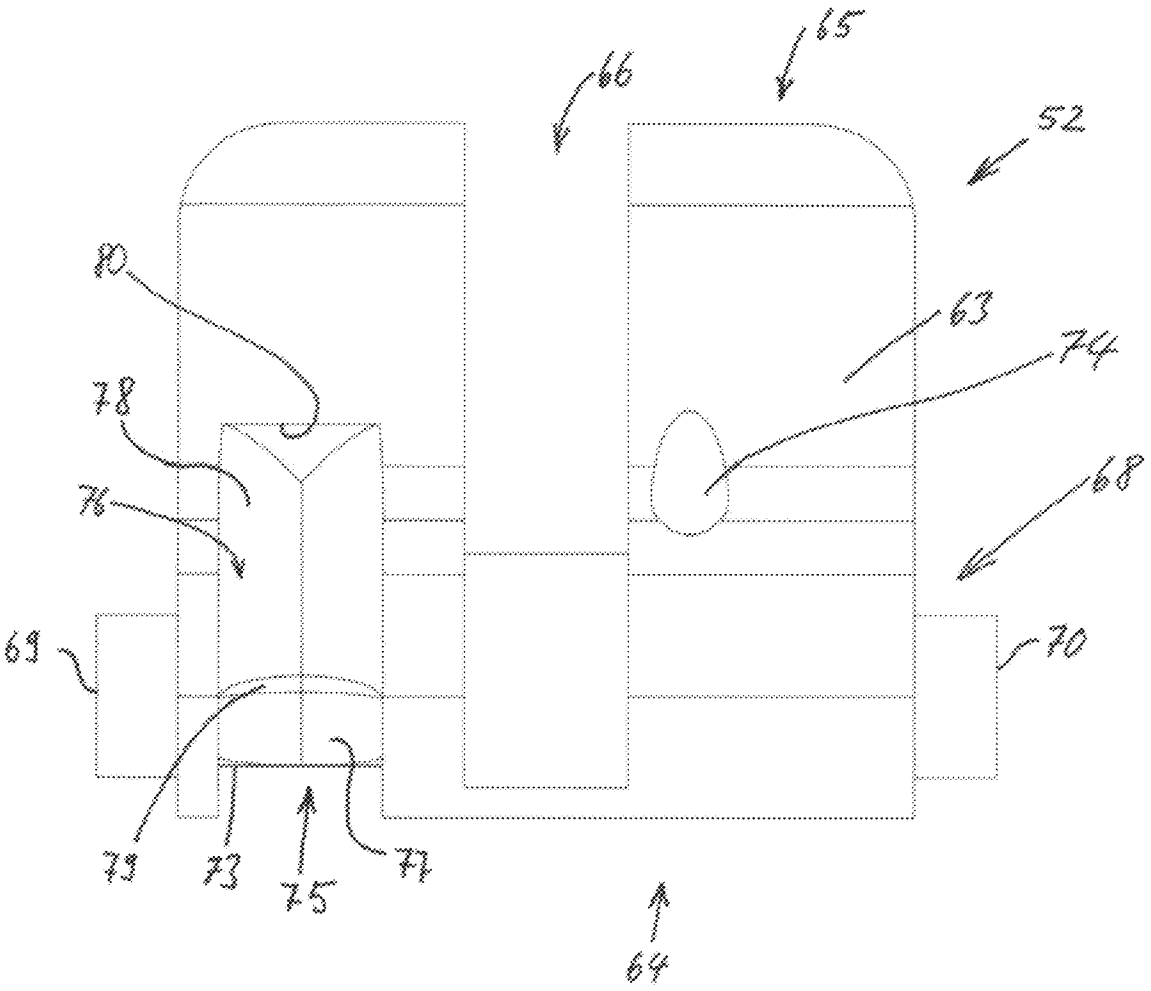
Figure 15:
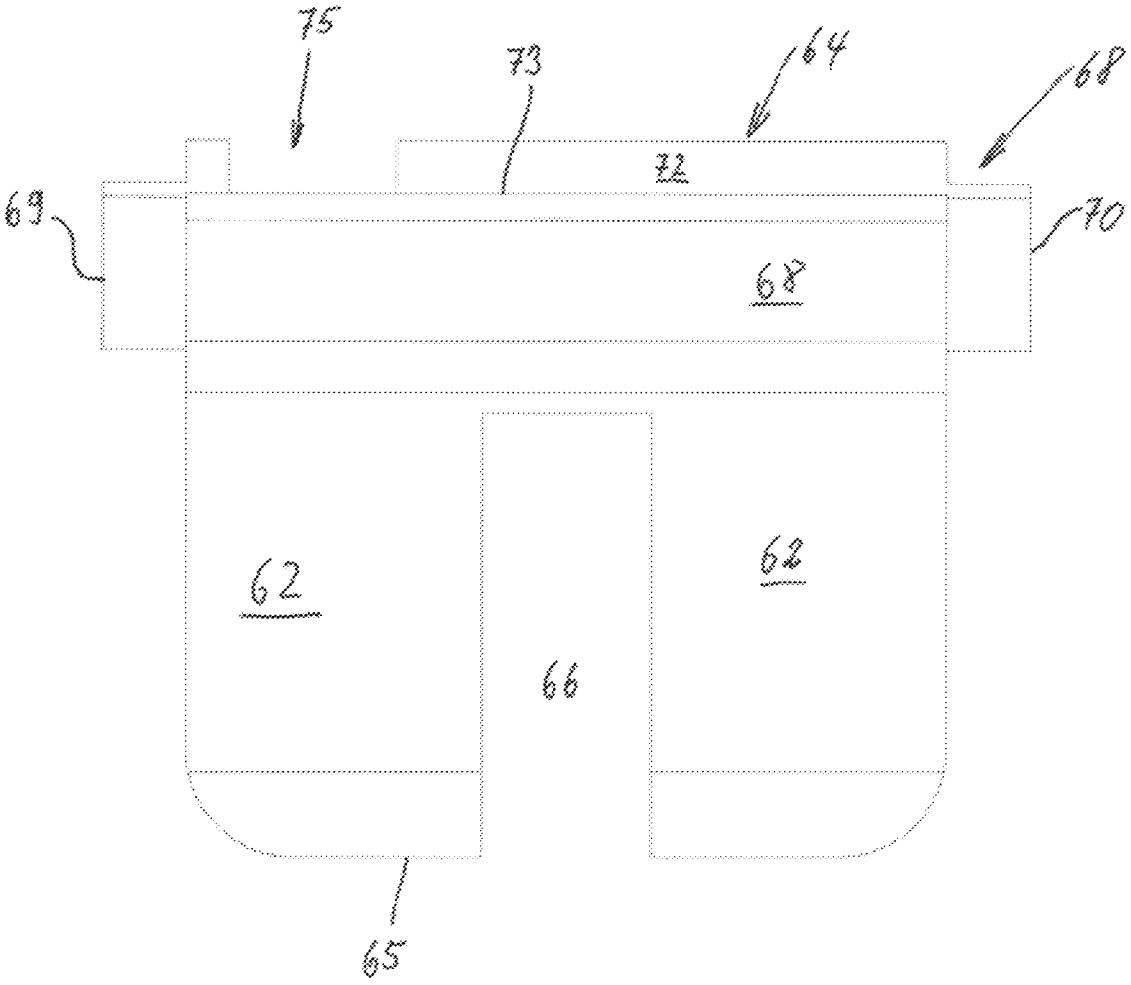
Figure 16:
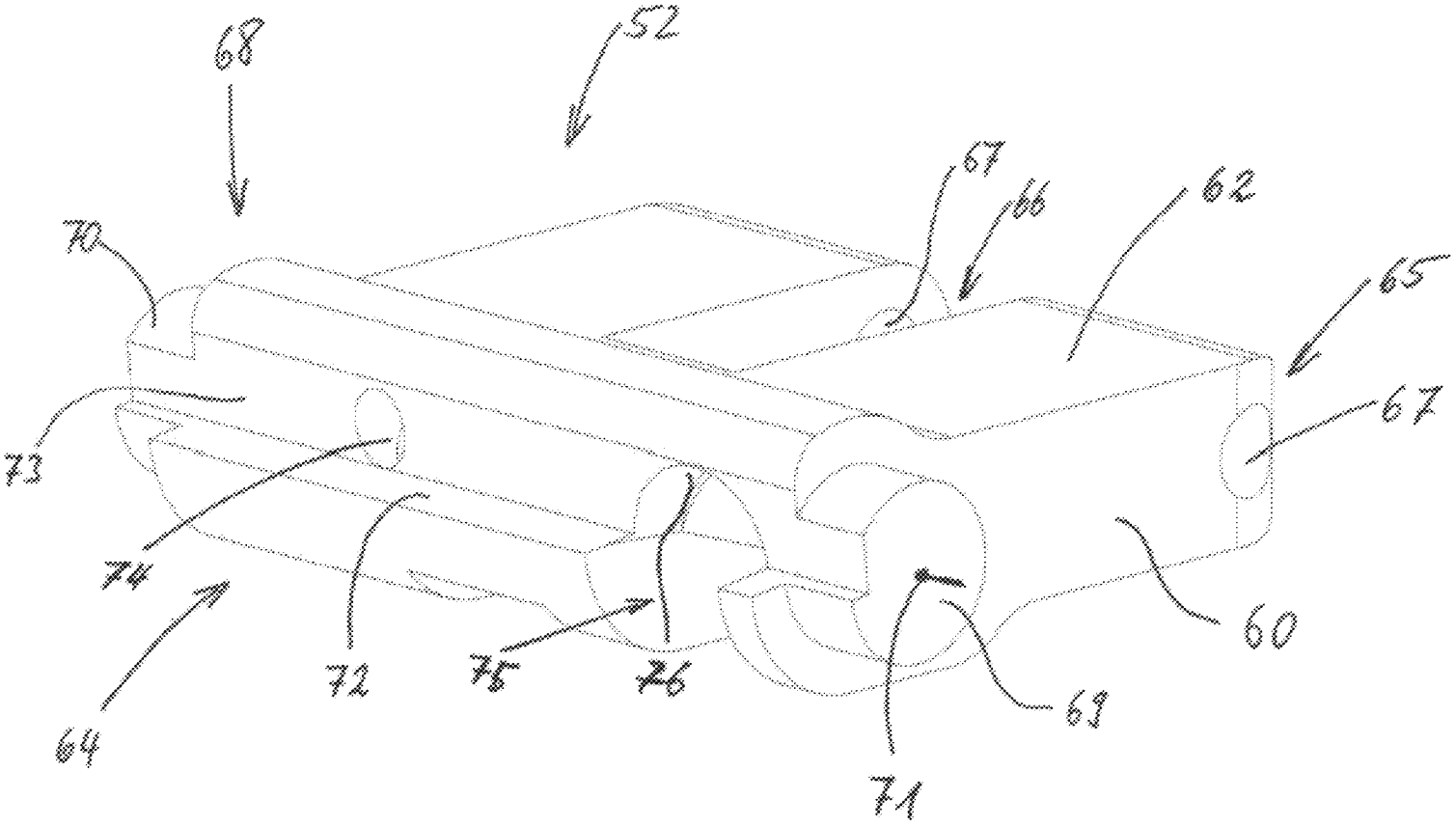
Figure 17:
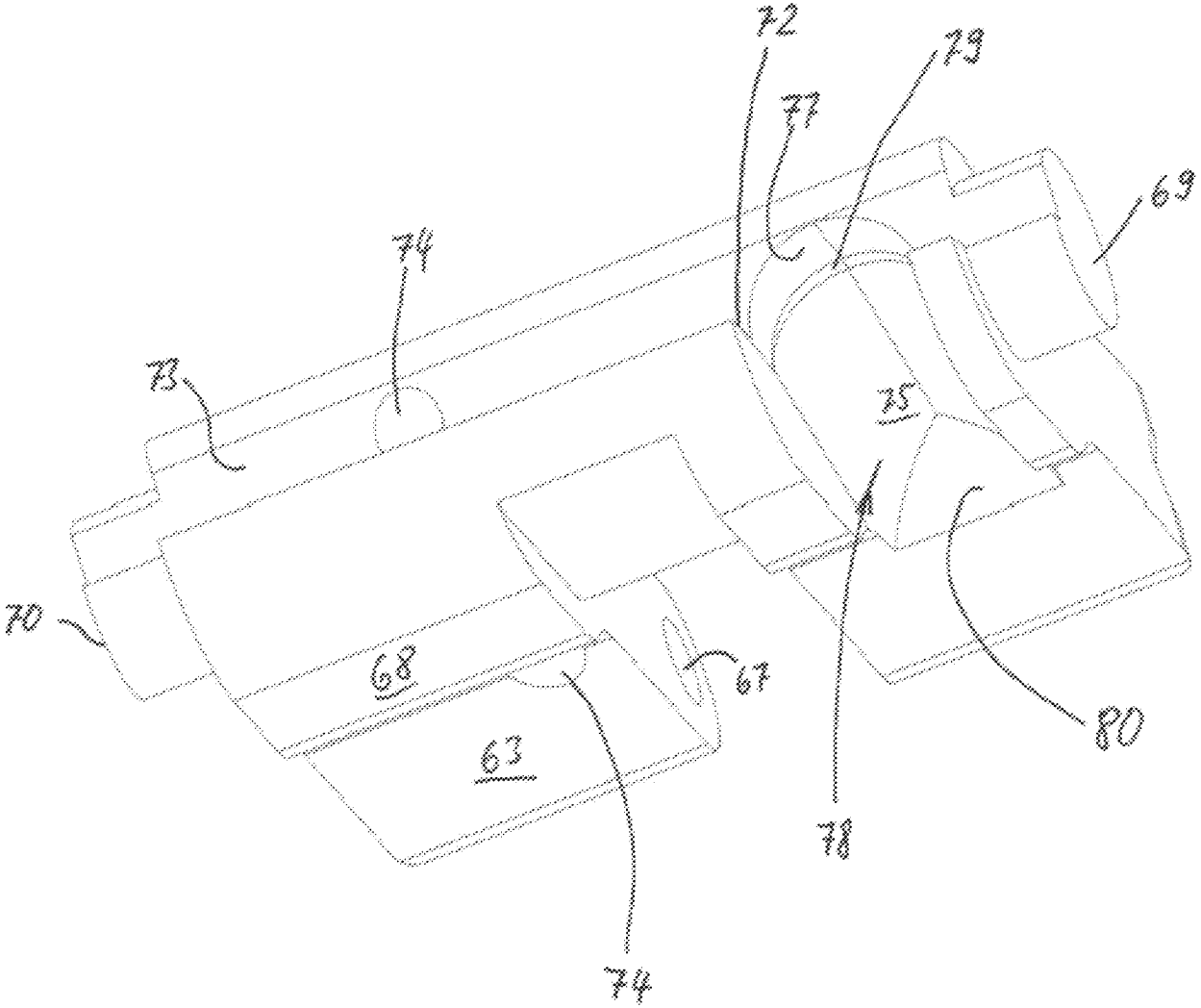

FIG. 3 the safety according to the invention with the toggle lever hammer, a safety rod, the safety lever, and a rotating bolt head action;

FIG. 4 shows a very schematic depiction of the function of the safety;

FIG. 5 shows another advantageous embodiment of a lock for a firearm with a toggle lever;

FIG. 6 shows the embodiment according to FIG. 5 in an activated-safety position;

FIG. 7 shows a perspective view of the embodiment according to FIG. 6;

FIG. 8 shows the embodiment according to FIG. 5 in a deactivated-safety position;

FIG. 9 shows the embodiment according to FIG. 8 in a perspective view from an opposite oblique viewpoint;

FIG. 10 shows a perspective view of the embodiment according to FIG. 9;

FIG. 11 shows the embodiment according to FIG. 5 in a fired position when it is in contact with a firing pin;

FIG. 12 shows the embodiment according to FIG. 11 in a view from beneath;

FIG. 13 shows the embodiment according to FIG. 12 in a view showing additional parts of the lock in which the firing pin is supported;

FIG. 14 shows the safety/guide lever of the embodiment according to FIG. 5 in a view from beneath;

FIG. 15 shows the safety/guide lever of the embodiment according to FIG. 5 in a view from above;

FIG. 16 shows the safety/guide lever of the embodiment according to FIG. 5 in a perspective view; and FIG. 17 shows the guide lever arm according to FIG. 16 in a perspective view from beneath.

The lock system 1 according to the invention has a hammer arrangement 2, a hammer actuating lever arrangement 3, a hammer bar 4, and a sear bar 5. In addition, a trigger transmission lever 6 and trigger slide 7 are provided.

The hammer arrangement 2 comprises a hammer 8 that is pivotable around a hammer rotation axle 9. The hammer 8 in this case has a hammer arm 10 extending away from the hammer rotation axle 9 and a cylinder segment region 12, which is positioned around the hammer rotation axle 9.

The hammer arm 10 extends away from the cylindrical region 12; the hammer arm 10 tapers from the width in the region of the hammer rotation axle 9 with two oblique steps 15. The oblique steps 15 in this case cause a tapering of the hammer arm 10; the oblique steps 15 extend obliquely from a top of the hammer arm to a bottom so that the oblique steps extend from top to bottom in the direction of the span of the hammer arm. At a bottom end of the oblique steps 15 or adjacent thereto, a rotation axle 17 is provided on the hammer arm 10. Embracing the rotation axle 17, two hammer actuating lever arms 16 are positioned on both sides of the tapered region of the hammer arm 10 and extend from the rotation axle 17 beyond the hammer arm 10.

To embody the invention, one hammer actuating lever arm 16 is sufficient.

The hammer actuating lever arms 16 in this case have a width that approximately corresponds to or is slightly smaller than the width of the steps 15.

Respective hammer cheeks 20 are positioned so that they rest externally against both sides of the cylindrical region 12. The rotation axle 9 also passes through the hammer cheek 20, which has a cylindrical region that is flush with the cylindrical region 12 and extends essentially in the same direction as the hammer arm 10 and can also be embodied of one piece with the hammer 8.

The hammer cheeks 20 in this case extend to the rotation axle 17 and the rotation axle 17 likewise passes through them so that the hammer lever arms 16 are bordered laterally by the hammer 8 and the hammer cheeks 20.

At their ends 16*a*, the hammer actuating lever arms 16 have bores that are aligned with each other through which a rotation axle 19 passes and between themselves, the lever arms border a connecting element 18; the hammer bar 4 is positioned transverse to the rotation axle 19 in the connecting element 18 and extends away from the hammer arrangement.

The hammer arrangement 2, which is composed of the hammer arm 8, the hammer cheeks 20, and the rotation axle 9 on the one hand and the hammer actuating lever arms 16, the rotation axle 17, the rotation axle 19, the connecting piece 18, and the hammer bar 4 on the other form a toggle lever arrangement such that when the hammer bar 4 moves toward the hammer arm 10, the hammer actuating lever arms 16 engage with the rotation axle 17 and deflect the hammer arrangement 2 downward toward a firing pin 30. But this only functions when the toggle lever arrangement is not moved upward beyond the dead point and is instead positioned below it, which is the case when the rotation axle 17 is positioned under the rotation axle 9.

With a hammer surface 14, the hammer arm 10 comes into contact with a hammer surface 31 of the firing pin 30.

Laterally next to the rotation axles 9 and 17, but closer to the rotation axle 9, there is a catch pin 21, which protrudes laterally beyond the corresponding hammer cheek 20. The catch pin 21 in this case is supported at least in the hammer cheek and/or in the hammer cheek and the hammer arm.

The hammer bar 4 is acted on with spring force in the direction of the hammer arm 8, for example by means of a mainspring (not shown), which is positioned around the hammer bar 4 and is supported against a stationary component while the hammer bar 4 is able to move axially.

The sear bar 5 is provided for triggering the hammer movement and for initially inhibiting it. The sear bar 5, with the underside of a free end 22, engages in a latch or a latch recess 25 in the cylindrical region of the hammer 8; the underside 23 of one end 22 of the sear bar 5 cooperates as a latch counterpart element for a flat latch surface 26 formed by the recess 25, which surface extends transversely, i.e. axially relative to the hammer rotation axle 9.

If the surface 23 rests against the surface 26, then the hammer arrangement 2 is held against the hammer bar 4 in opposition to the spring force and as a result, the hammer actuating lever arms 16 are held away from sear bar 5. In this case, the sear bar 5 can be moved axially out of engagement with the surface 26 and the recess 25 and then back into engagement with them.

Figure 1:
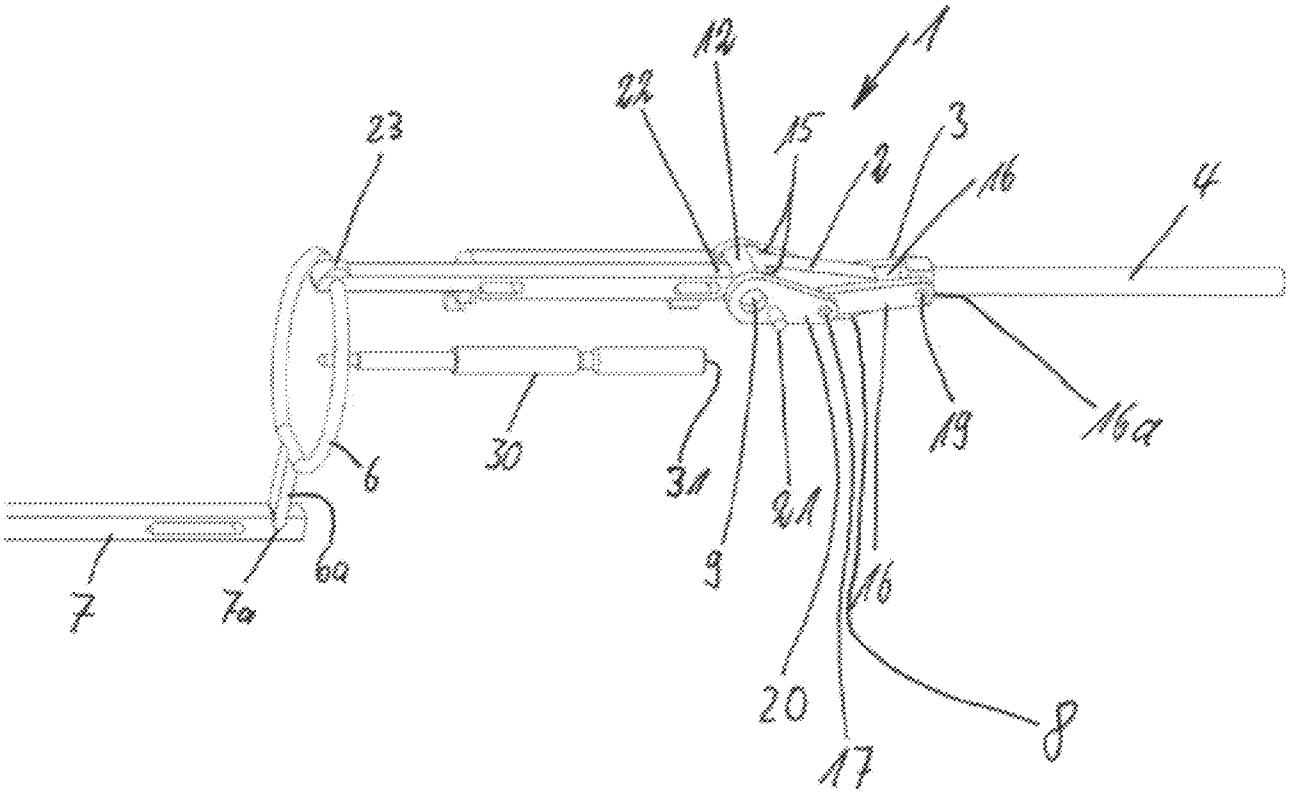
FIG. 1 shows a very schematic depiction of the lock with the toggle lever hammer, the sear bar, the trigger transmission, and a firing pin.

If the sear bar 5 is moved out of the latch 25, then the hammer arm 10 is moved abruptly downward by the hammer bar 4 via the hammer actuating lever arms 16 into a bolt travel path and with its surface 14, strikes the surface 31 of the firing pin 30, which triggers the firing. In this case, the firing pin 30 is positioned in a bolt (FIG. 4); after firing, the bolt can be moved away from the direction of fire manually or by means of gas in a gas-operated weapon or by means of recoil in a recoil-operated weapon and in so doing, acts on the hammer arm 10 and pivots it around the hammer bar 4 upward again in opposition to the pressure of the spring, back into the starting position (FIG. 1) and thus reengages the lock.

In this case, the sear bar 5 is spring-loaded so that the engagement of one end 22 in the recess 25 is overridden in opposition to the spring force and after the actuation of the trigger, the hammer bar 4 rests against the hammer 8 or more precisely stated against the cylindrical region 12 of the hammer 8 so that as the hammer arm 8 is pivoted by the bolt (not shown), when the surface 26 comes into the region of the surface 23, the hammer bar 4 snaps back into the recess 25 with its free end 22 so that the cocked position is once again secured by the latched engagement.

Figure 2:
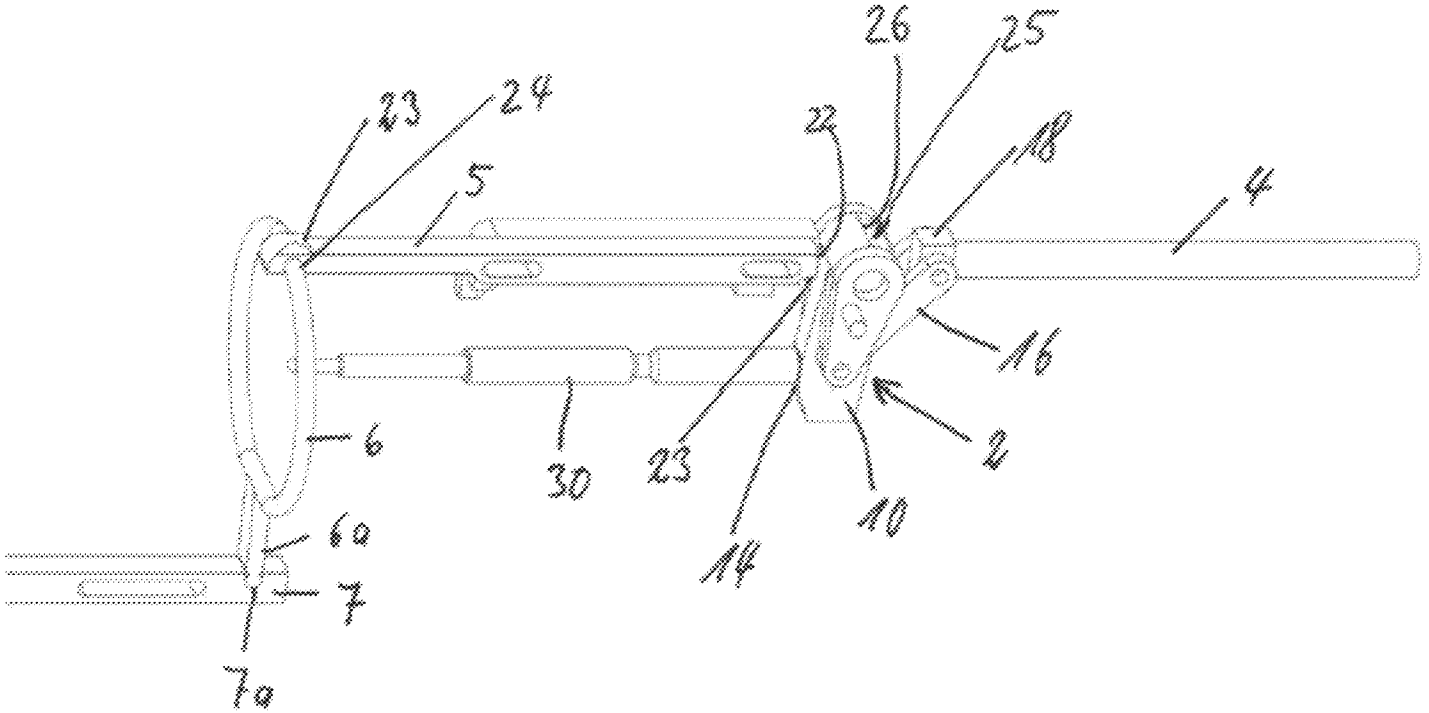
FIG. 2 shows the apparatus according to FIG. 1 in a fired state.

In order for a movement of a trigger, which is usually actuated with the finger, to be transmitted to the top of the weapon, according to the invention (FIGS. 1, 2) a trigger transmission lever 6 is provided, which transmits the movement of a trigger slide 7, which is positioned on the underside of the weapon, in particular in a rail arrangement (not shown), to the top of the weapon.

The trigger transmission lever 6 is positioned at a free end 23, which is diametrically opposite from the free end 22 of the sear bar 5, and is supported there in articulating and in particular rotatable fashion.

For example, the trigger transmission lever 6 passes through a bore 24 and is supported in it in rotatable fashion.

On the underside of the weapon, the trigger transmission lever 6 is likewise supported in articulating fashion in the trigger slide 7 and in particular, the trigger transmission lever 6 there likewise passes through a bore or is supported in articulating fashion with an actuating section 6*a* in a corresponding articulation recess 7*a*.

So that a movement of the trigger slide 7 away from the direction of fire produces a movement of the sear bar 5 in the direction of fire and thus the release of the latched connection between the free end 22 and the recess 25, the trigger transmission lever 6 has a corresponding counter support or lever support around which it rotates.

The trigger transmission lever 6 in this case can be embodied so that it surrounds the components that are positioned between the lock, which is positioned on the top of the weapon, and the trigger slide 7, which is positioned on the underside of the weapon. In particular, these components can be a barrel extension, a barrel with a cartridge chamber, the bolt, or a region in which the bolt travels, namely the bolt travel path.

To this end, the trigger transmission lever 6 is embodied, for example, as a ring, which passes through the bore 24 of the sear bar 5 and in the same way, either passes through the trigger slide 7 or is connected in articulating fashion to the actuating section 6*a* in the opening 7*a*.

Instead of a ring-shaped embodiment of the trigger transmission lever, it can also be C-shaped or curved in some other way or embodied in the shape of a question mark or the like; the curved part preferably has a radius, which is sufficient to surround the usually cylindrical components, which are positioned between the top and underside, and then continues with the section 6*a* in the direction toward the trigger slide 7.

A safety arrangement 40 is provided in order to secure the above-described releasing procedure.

The safety arrangement 40 is composed of a safety rod 41, a safety transmission lever 42, a safety slider 43, and the catch pin 21.

The safety arrangement (FIGS. 3, 4) is a safety rod 41, which in particular extends parallel to the sear bar 5; the safety rod 41 is axially movable relative to the longitudinal axis of the weapon in the same way as the sear bar 5. The safety rod 41 in this case is embodied as flat and elongated, with narrow sides facing up and down and wide sides facing laterally.

The safety rod 41 is positioned adjacent and to the side of the hammer cheek 20 that has the catch pin 21, preferably immediately adjacent to it or resting lightly against it.

From its upper narrow side 44 adjacent to the hammer arrangement 2, the safety rod 41 has a recess 45, which extends downward, for example by the width of the catch pin 21. In the region of a free end 46 of the safety rod 41, the recess is embodied as continuously extending to a lower narrow side 47; the recess 45 does not extend from the wide side to the wide side of the safety rod 41, but instead, the safety rod 41 is embodied as continuous on the wide side facing away from the hammer cheek 20 so that the recess 45 or flute 45 extends only over a partial width of the safety rod 41. The flute 45 becomes deeper in the region of the free end 46, as has already been explained, extending to the lower narrow side 47, forming an oblique surface 48.

Spaced apart from the oblique surface 48, the end region 49 of the safety rod 41 once again has its full dimensions, a surface 50 being formed, which extends obliquely from the bottom to the top.

The width of the flute 45 and of the complete break in the region of the free end 46 in this case is dimensioned so that it corresponds approximately to the amount by which the catch pin 21 protrudes out from the hammer cheek 20.

As already explained, the safety rod 41 is embodied as axially movable. In a deactivated-safety position (FIG. 3), the hammer arrangement 2 is in a cocked and ready-to-fire state. In this state, the catch pin 21 is positioned between the oblique surfaces 48, 50 and can therefore be pivoted toward the underside or downward without contacting the safety rod 41. In this position, it is thus possible to trigger a shot.

In order to secure the lock in position, the safety rod is slid toward the hammer arrangement 2, as a result of which the catch pin 21 slides along the oblique surface 48 into the flute 45. This lifts up the entire toggle joint arrangement so that the rotation axle 17 is positioned above the rotation axle 9. By means of this, the toggle lever arrangement is pivoted through the dead point away from the direction of fire, from which position—according to the nature of the toggle lever—it cannot return without external influence.

If the hammer bar 4 were to then execute a movement toward the hammer arm 8 for whatever reason, or if the toggle lever were to be acted on by an impetus in the direction toward the dead point, then the hammer 8 would also be moved away from the firing pin 30. The force of the hammer bar 4 therefore also performs a securing function since the hammer 8 is kept away from the firing pin actively and by means of the spring force of the mainspring. In addition, the catch pin 21 rests in the flute 45, which also makes it impossible for a movement to occur in the direction of the firing pin.

In order to disengage the safety of the weapon, the safety rod is moved in the direction of fire until the catch pin 21 is once again positioned in the region between the oblique surfaces 48 and 50. Even in this state, a firing is not possible since the hammer bar 4 or more precisely stated, the mainspring around the hammer bar 4 (not shown) still keeps the toggle lever arrangement composed of the hammer arrangement and hammer actuating lever arrangement away from the firing pin by means of the spring force.

In order to move the lock into the firing position, the safety rod 41 is thus moved farther in the direction of fire so that the catch pin 21 slides along the oblique surface 50 and thus the lock or more precisely, the toggle lever arrangement composed of the hammer arrangement and hammer actuating lever arrangement, is moved through the dead point of the toggle lever (downward) into the firing position. In this firing position, the free end of the sear bar 5 is then once again positioned in the recess 25 so that the surfaces 22 and 26 now rest against each other with the pressure of the mainspring (not shown).

In a preferred embodiment, the safety arrangement 40 above the safety rod 41 has a rotation prevention means for the bolt. The bolt is used for closing the barrel toward the rear and for conveying the cartridge into the cartridge chamber. The bolt 35 preferably has a locking pin 36, the locking pin 36 being positioned on a surface of the bolt body. Preferably, the safety rod 41 has a lock or pocket formed onto/into the underside, which in the activated-safety position is positioned around the safety pin 36 or in the vicinity thereof so that the safety pin 37 or safety pocket 37 inhibits a rotation of the bolt in the opening direction.

In addition, the safety rod 41 has a safety transmission lever 42 positioned at a free end 45 of the safety rod 41, the free end 45 of the safety rod 41 being positioned diametrically opposite from the free end 46.

For example, the safety transmission lever 42 is arranged around the bolt and/or a cartridge chamber and in the same way as the trigger transmission lever 6, can be embodied as round, C-shaped, or the like, being arranged resting in a recess 51 of the safety rod 41, which either passes through the safety rod from the wide sides or is provided extending from a lower edge 47 and rests in an opening of a bore or recess of the safety slider 43 at an opposite end 52.

The safety transmission lever 42 also has a pivot point between the recesses 46 and the safety slider 43 in order to bring about a rotation around a pivot point so that a sliding movement of the safety slider 43 away from the direction of fire moves the safety rod 41 in the direction of fire and thus disengages the lock system 1.

The invention has the advantage of producing a very rugged, safe lock with a high degree of operational safety and ruggedness; the placement of the lock system 1 on the top of a weapon and the transmission of a triggering movement or safety-engaging movement from the underside to the top of the weapon achieves a very compact embodiment of the weapon.

Another advantageous embodiment of the invention has a lock system 50 in which the functions have been swapped, so to speak.

The lock system 50 comprises the toggle lever arrangement by means of a hammer lever arm 51 and a guide lever arm 52. The hammer lever arm 51 is an elongated component, which at one end 53 is connected to the hammer bar 4. At the end 53, the hammer lever arm 51 can be pivoted around a rotation axle 54 that passes through two cheeks 55, which are positioned at one end of the hammer bar 4 and embrace the end 53 between themselves, and passes through the end 53. Consequently, the hammer lever arm 51 can be pivoted around the axle 54 or shaft 54.

At a diametrically opposing end 56 of the hammer lever arm 51, there is an angled hammer surface 57. Spaced apart from the end 56 and from the hammer surface 57 toward the end 53, but spaced significantly less far from the end 56, there is a guiding rotation shaft 58, which passes through the hammer lever arm 51. The free end 56 of the hammer lever arm, which protrudes beyond the shaft 58 and has the hammer surface, thus constitutes the actual hammer.

With the guiding rotation shaft 58, the hammer lever arm 51 is mounted on the guide lever arm 52 in pivotable fashion.

The guide lever arm 52 (FIGS. 14-16) is a flat, plate-like element with two side surfaces 60, 61, a top 61, a bottom 63, a front end region 64, and a rear end region 65. An accommodating slot 66 for accommodating the hammer lever arm 51 extends from the rear end region 65 to the front end region 64 over a partial length of the guide lever arm 52 approximately in the middle between the two side surfaces 60, 61. In the region of the rear end region 65, a transverse bore 67 is provided, which extends through from the surface 60 to the surface 61 and serves to accommodate the guiding rotation shaft 58.

The front end region 64 of the guide lever arm 52 is embodied as rounded and thickened between the surfaces 60 and 61 so that the surfaces 62, 63 as well as the top 62 and bottom 63 in the region of the end 64 thicken to form a more cylindrical region 68.

Extending laterally beyond each of the side surfaces 60, 61 and positioned quasi-concentric to the cylindrical region 68, the thickened cylindrical region 68 of the front end region 64 has respective cylindrical shaft stubs 69, 70 that define a guide lever arm rotation axis 52. By means of the axle stubs 69, 70, the guide lever arm 52 is mounted in rotatable fashion on a chassis of a firearm (not shown).

Approximately at the same height and along the span of the rotation axis 71, the cylindrical region 68 is provided with a latch step 72, which extends along the rotation axis 71 and partway into the region 68 and thus also extends into the shaft stubs 69, 70. The latch step 72 also forms a wall 73 that is orthogonal thereto, which extends upward from the latch step 72.

The latch step 72 here preferably extends inclined slightly downward toward the outside relative to the top 62 of the guide lever arm 52 and the bottom 63 thereof.

In relation to the plane that is defined between the rotation axis 71 on the one hand and the rotation axle of the receiving bore 67 and the axis of the shaft 58 on the other, the latch step 72 is inclined downward toward the outside at an angle of 3 to 25°.

Extending obliquely downward from the wall 73 to the surface 63 and approximately in the transverse middle of the guide lever arm 52 between the ends 64 and 65, a threaded bore 74 is provided, which serves to accommodate a grub screw that can be screwed in to adjust the latch length and thus the trigger travel to a sear bar that will be described in greater detail below.

The bore 74 in this case is positioned closer to a surface 61, i.e. between the surface 61 and the slot 66, adjacent to the slot 66.

Between the surface 60 and the slot 66, a recess from the front 64 is provided in the underside 63 and extends, for example, across approximately half of the span of the guide lever arm 52 from the front 64 toward the back 65. The recess is embodied so that in this region, a relief is provided in the underside 63 including the cylindrical region 68. From the underside of the cylindrical region, the recess 75 extends into the guide lever arm 52, the recess 75 having a recess roof 76 toward the top 62. The recess roof 76 has a front region 77, a rear region 78, and a transition 79 between them. The front region 77 extends in semicircular fashion from the wall 73 into the cylindrical region 68 of the guide lever arm 52, with the front region 77 in this case extending obliquely to a top of the cylindrical region 68. Approximately at the height of the shaft stubs 69, 70, the front recess roof region 77 reaches the transition region 79 in which the spatial orientation of the recess roof 76 changes so that the transition region 79 extends to a recess end 80 of the rear recess roof region 78 in the direction toward an underside 63, likewise with a semicircular cross-section oriented toward the recess 80 so that the front recess roof region 77 and the rear recess roof region 78 are inclined relative to each other at an angle, in particular at an angle of 25° to 50°.

It goes without saying that for practicability reasons and particularly for production reasons, the recess roof 76 is embodied as semicircular or in the form of a segment of a circle, but these regions can easily also be embodied as flat.

In the assembled state (FIG. 5), the hammer lever arm 51 and the guide lever arm 52 comprise the toggle lever arrangement. In this case, the guide lever arm 52 can be pivoted up and down around the shaft stubs 69, 70, the hammer lever arm 51 can be pivoted up and down around the shaft 54, and the two are connected to each other via the shaft 58.

The toggle lever arrangement composed of the hammer lever arm 51 and the guide lever arm 52 in this case is acted on with spring force by means of the hammer bar 4 and a mainspring (not shown) positioned around it.

In this case, the guide lever arm 52 is mounted on the chassis of a firearm by means of the shaft stubs 69, 70 while the hammer lever arm 51 and the hammer bar 4 are able to move to a limited degree in the direction of fire and away from the direction of fire by pivoting the toggle lever arrangement.

Analogous to the toggle lever arrangement described at the beginning, the toggle lever arrangement composed of the hammer lever arm 51 and guide lever arm 52 is in an activated-safety position when the shaft 58 is positioned above the shaft stubs 69, 70 (FIGS. 5, 6, 7), is in a deactivated-safety, ready-to-fire position when the shaft 58 or its rotation axis is positioned below the shaft stubs 69, 70 or their rotation axis (FIGS. 8, 9, 10), and is in a fired position (FIGS. 11, 12, 13) when the rotation shaft or guiding rotation shaft 58 is positioned partially below or entirely below the shaft stubs 69, 70 as a result of which, the hammer bar 4 is positioned the farthest forward in the direction of fire and the hammer surface 57 of the end 56 of the hammer lever arm 51 serving as a hammer is positioned so that it is resting against a firing pin 30 (FIGS. 11, 12, 13).

In order to pivot the guide lever arm 52 and thus bring about the activated-safety and deactivated-safety position, a safety rod 85 is provided. For example, the safety rod 85 is embodied as elongated and has a square and/or rectangular cross-section with a top 86 and a bottom 87. Parallel to the top 86 and bottom 87, the side walls 88 are provided with continuous guide slots 89, which have corresponding bolts, shafts, or the like (not shown) passing through them and hold the safety rod 85 so that it is able to move axially, but is otherwise stationary relative to a firearm chassis.

The safety rod 85 has an end 90 oriented toward the front of the firearm; in the region of the front end 90 at the bottom 87, a recess 91 is provided for the lever 42 (not shown) that has already been described in connection with the first embodiment.

The safety rod 85 also has a back end 92.

Between the front end 90 and the back end 92, adjacent to the recess 91 toward the back end 92 and approximately at the height of a slot 89, the bottom is embodied with a control surface 93, which widens out the safety rod with a kind of ramp at its height between the bottom 87 and top 86 starting from the region of the recess 91.

In the region of the end 92, the safety rod 85 is embodied with a rounding 94 on its top 86; for example, the rounding 94 is embodied as semicircular and/or has at least two oblique surfaces 94, the free end 92 of the top being embodied with a control bead 95, which protrudes in a rounded shape at the top.

The bead 95 is embodied so that it can cooperate with the recess 75 and especially with the recess roof 76 and in particular, has a corresponding shape such that it can cooperate as it rests against the recess roof 76 in the most form-fitting, full-contact way possible.

The width of the safety rod 85 is dimensioned so that it corresponds to the width of the recess 75 or is slightly smaller; the bead 95 is curved in such a way that it can cooperate in sliding fashion with the front recess roof region 77 and the rear recess roof region 78; and with a flat embodiment of the roof regions, the bead is optionally only arched in the longitudinal direction, but is flat in the transverse direction.

The safety rod 85 in this case functions as follows. A starting position is the deactivated-safety, cocked position of the lock, in which—for example after the loading or a firing and the repeating motion—the lock is in a ready-to-fire state (FIGS. 8, 9, 10).

In this position, the control bead 95 is positioned at the entry to the recess 75 in the region of the wall 73. The guiding rotation shaft 58 is positioned below the rotation axis 71 of the guide lever arm 52. If the lock is to be secured, the safety rod 85 is then slid away from the direction of fire into the recess 75. As a result of this, the bead 95 first slides on the top along the front recess roof region 77 before it travels into the transition region 79 and then comes into contact with the rear recess roof region. Since the safety rod 85 cannot move up or down out of the way, with a further forward movement, the guide lever arm 52 is pivoted around the rotation axle since the bead 95 slides along the obliquely extending rear recess roof region 78 and as a result, it lifts the guide lever arm 52. Through this movement, the toggle lever arrangement composed of the hammer lever arm 51 and guide lever arm 52 is slid toward the hammer bar 4 in opposition to the pressure of the mainspring (not shown) and in is brought into the region of the dead point in which the toggle lever arrangement has its greatest length. As the bead 95 is slid further into the recess 75, the guide lever arm and the hammer lever arm are pivoted upward beyond the dead point (assisted by the mainspring) so that the activated-safety position (FIGS. 5, 6, 7) is achieved in which in particular, the front recess roof region 77 is supported on a top 86 of the safety rod 85 so that a further pivoting is not possible. The toggle lever arrangement composed of the hammer lever arm 51 and guide lever arm 52 is secured in this position by the pressure of the mainspring (not shown). Also in this position, the bead 95 rests against the rear recess roof region from underneath in the region of the end 80 of the recess and also inhibits a pivoting as a result. This state is thus secured in two ways.

In order to switch from this activated-safety position (FIGS. 5-7) back into the ready-to-fire position, the safety rod 85 is moved in the direction of fire, which causes a front side 96 of the bead 95 to first travel into the region 79 and then into the region of the front recess roof region. The front recess roof region is then deflected by the front side 96 of the bead 95 in opposition to the force of the mainspring (not shown) and as a result, the toggle lever arrangement composed of the hammer lever arm 51 and guide lever arm 52 is initially deflected to the dead point in which the mainspring experiences the most powerful compression and the toggle lever arrangement has its greatest elongation relative to the longitudinal axis of the weapon. After the front side 96 of the control bead 95 has fully pivoted the front recess roof region 77, the shaft 58 is once again positioned below the rotation axis 71. In this state, the toggle lever arrangement composed of the hammer lever arm 51 and guide lever arm 52 is not held by the safety rod 85, but rather by a sear bar 98.

The sear bar 98 is parallel to the safety rod 85, but is positioned approximately in the transverse middle of the guide lever arm 52. The sear bar 98 is likewise a rod with a square and/or rectangular cross-section, with a front end 99 and a rear end 100. Flush with the transversely extending recesses 89 of the safety rod 85, the sear bar has recesses 101, which have the same pins passing through them as the recesses 89 in order to enable an axial movement, but inhibit a movement up or down.

In the region of the front end 99, the sear bar 98 has a recess 102 for a lever 6, with which it is possible to actuate the sear bar from the underside of the weapon.

At its free end 100, the sear bar has a region with a flat bottom surface (not shown), which is embodied in the same way as the first embodiment of a sear bar so as to cooperate with the latch step 72 of the guide lever arm 52 to inhibit a rotation of the guide lever arm 52.

In this case, a front end surface 103 of the sear bar 98, which is usually orthogonal to the bottom surface, can rest against the wall 73 in the region of the bore 74. By means of a screw positioned in the bore 74, it is possible to adjust the position of the sear bar 98 and in particular the degree of overlap between the latch step 72 and the lower surface in the region of the free end 100 of the sear bar 98.

In the region of their front ends 99, the sear bar 98 and the safety rod 85 can each have an abutment 104 on top, each of which has a receiving bore 105, in particular for a compression spring (not shown) that exerts pressure on the safety rod in the direction toward an activated-safety position and on the sear bar in a locked position. For the sear bar, these compression springs are optional, not mandatory.

In an advantageous embodiment, the lock 50 also has a locking rod 110.

The locking rod 110 extends parallel to the sear bar 98 and is embodied and functions in the same way as a sear bar 98; an abutment 104 and a receiving bore 105 for a compression spring (not shown) are also provided. In addition, the locking rod likewise has a bottom surface (not shown) and an end surface 103 with which the locking rod can be brought into engagement with the latch step 72 in the same way as the sear bar. On the underside, the locking rod 110 has a control projection 111 with which the locking rod can be brought into and out of the latched engagement and thus the locked position.

The purpose of the locking rod is to prevent inhibit the lock from being released when the bolt is not in a forward position, but is instead positioned behind the lock in the direction of fire relative to the longitudinal axis of the weapon. If the weapon were fired in this state and the bolt were subsequently moved toward the front, then the bolt would travel from the rear and come into contact with the fired hammer lever arm 51 and might possibly damage the lock.

This embodiment has the advantage that because the toggle lever is composed only of the hammer lever arm 51 and the guide lever arm 52, this ensures a relatively simple embodiment of the toggle lever arrangement.

It is also advantageous that the bore in the guide lever arm permits a very reliable, but also force-reducing activation and deactivation of the lock.

It goes without saying that the above-described geometrical embodiment of the hammer lever arm 51 and guide lever arm 52 can also be modified for the sake of the practicability of the invention and in particular, can be simplified significantly.

REFERENCE NUMERAL LIST

1 lock system
2 hammer arrangement
3 hammer actuating lever arrangement
4 hammer bar
5 sear bar
6 trigger transmission lever
7 trigger slide
8 hammer/lever arm
9 hammer rotation axle
10 hammer arm
12 cylinder segment region
14 hammer surface
15 steps
16 hammer actuating lever arm/lever arm
17 rotation axle
18 connecting element
19 rotation axle
20 hammer cheek
21 catch pin
22 free end/surface
23 underside/free end
24 bore
25 latch recess
26 latch surface
30 firing pin
31 hammer surface
40 safety arrangement
41 safety rod
42 safety transmission lever
43 safety slider
44 upper narrow side
45 recess
47 narrow side
48 oblique surface
49 end region
50 oblique surface
51 hammer lever arm/lever arm
52 guide lever arm/lever arm
53 end of 51
54 rotation axle
55 hammer cheeks
56 end of 51
57 hammer surface
58 guiding rotation shaft/rotation axle
60 side surface
61 side surface
62 top
63 bottom
64 front end region
65 rear end region
66 accommodating slot
67 transverse bore
68 cylindrical region
69 shaft stub/axle stub
70 shaft stub/axle stub
71 rotation axis
72 latch step
73 wall
74 bore for trigger-adjusting screw
75 recess
76 recess roof

77 front recess roof region
78 rear recess roof region
79 transition region
80 recess end
85 safety rod
86 top
87 bottom
88 side wall
89 recess
90 front end
91 recess
92 rear end
93 control surface
94 oblique surface/rounding
95 control bead
96 front surface of 95
98 sear bar
99 front end/free end
100 rear end/free end
101 recess
102 recess
103 end surface
104 abutment
105 receiving bore
110 locking rod
111 control projection

The invention claimed is:

1. A lock system for a firearm having an arrangement comprising at least two lever arms (8, 52; 16, 51); the lever arms (8, 52; 16, 51) are connected to a rotation axle (17, 58) in articulating fashion to yield a toggle lever; the resulting toggle lever being pivotable to both sides of a dead point in which the arrangement is maximally extended; and one of the lever arms (8, 51) is embodied as a hammer for a firing pin (30).

2. The lock system according to claim 1, characterized in that a pivoting direction to a side of the dead point closer to the firing pin (30) defines a released position and a pivot to the other side of the dead point defines a safety position.

3. The lock system according to claim 1, characterized in that the at least one lever arm (16, 51) acts on the rotation axle (17, 58) under the pressure of a spring so that the dead point must be overcome in opposition to the pressure of the spring.

4. The lock system according to claim 2, characterized in that in the released position, a lever (8, 52) with a latch (25, 73) is embodied so that it cooperates in a detachable way with a latch counterpart or surface (22) of a sear bar (5, 98).

5. The lock system according claim 1, characterized in that the system including the lever arms (8, 52; 16, 51) is positioned at the top of a weapon above a bolt travel path.

6. The lock system according to claim 5, characterized in that in order to transmit a trigger movement of a trigger tongue to a sear bar (5, 98) positioned above the bolt path, a trigger transmission lever (6) is provided, which transmits the movement of a trigger slide (7), which is positioned at the underside of the weapon, to the top of the weapon.

7. The lock system according to claim 6, wherein the trigger transmission lever (6) is positioned at a free end (23, 99) diametrically opposite from a free end (22, 100) of the sear bar (5, 98) and is supported there in articulating fashion and toward the underside of the weapon, the trigger transmission lever (6) is likewise supported in articulating fashion in the trigger slide (7); the trigger transmission lever (6) is guided around the components situated between the top of the weapon and the underside of the weapon and/or around a bolt travel path so that movement of the trigger slide (7) in one axial direction is converted into a movement of the sear bar (5, 98) in the opposite axial direction or into an increased or decreased movement of the sear bar (5, 98) in the same direction.

8. The lock system according to claim 6, characterized in that in a cocked, unreleased position of the lock, the sear bar (5, 98), with the underside of a free end (22, 100), engages in a latch (72) or latch recess (25) in the cylindrical region (68) of the one lever (8, 52); the underside (23) of one end (22, 100) of the sear bar (5, 98) serves as latch counterpart element for a flat latch surface (26, 72) formed by the recess (25), which extends transversely, i.e. axially relative to the hammer rotation axle (9), so that the lock holds the lever arrangement (2)—in opposition to the pressure of a spring—against a hammer bar (4), which is connected in articulating fashion to the other lever arm (16, 51) and is held by the sear bar (5, 98) when the surface (23) of the sear bar is resting against or on the surface (26, 72) of the lever.

9. The lock system according to claim 8, characterized in that the sear bar (5, 98) is positioned so that it can move axially into and out of the latched engagement between the surfaces (23; 26, 72); the sear bar (5, 98) is spring-loaded in the direction toward the engagement so that the release of the latched connection must take place in opposition to the pressure of a spring.

10. The lock system according to claim 6, characterized in that in addition, a safety is provided; the safety comprises a safety rod (41, 85); and the safety rod has means (48, 50; 95, 96), which are embodied to cooperate with counterpart means (21; 77, 78) of one of the levers (8, 52) in such a way that to activate the safety, the means (48, 50; 21; 95, 96; 77, 78) pivots a toggle lever arrangement (50) of the hammer arrangement (2) out of the released position through the dead point into the safety position and to deactivate the safety, pivots it out of the safety position through the dead point into the released position.

11. The lock system according to claim 1, characterized in that the lock has a hammer arrangement (2), which has a hammer (8) and at least one hammer actuating lever arm (16); the hammer (8) is pivotable around a rotation axle (9) toward and away from a firing pin (30) and at least one hammer actuating lever arm (16) is linked to the hammer (8) by means of a rotation axle (17); the rotation axle (17) is positioned remote from the rotation axle (9) on the hammer (8); and the hammer (8) and hammer actuating lever arm (16) form a toggle lever, which can be pivoted around the rotation axle (17) to both sides of a dead point.

12. The lock system according to claim 10, characterized in that as means, the safety rod (41) has two oblique surfaces (48, 50), which have an inclination oriented in the same direction, and the means (21) on the hammer arrangement (2) is a laterally protruding pin so that by means of the pin (21) sliding along an oblique surface (48), the hammer arrangement moves through the dead point into the safety position and when the safety rod (41) is moved into the firing position, the oblique surface (50) moves the pin and thus the hammer arrangement (2) out of the safety position, through the dead point, and into the firing position or released position.

13. The lock system according to claim 12, characterized in that in the safety position, after being pivoted through the dead point, the pin (21) rests against the flute bottom of a flute (45) in the safety rod, which blocks the movement of the pin and thus of the hammer arrangement (2) into the released position.

14. The lock system according to claim 10, comprising a safety arrangement (40) having a rotation prevention means for a bolt of the firearm; the bolt has a locking pin (36) and the safety rod (41) has a catch, lug, or pocket, which, when the safety is activated, is placed around the safety pin (36) or, in order to block a movement in a rotation direction, rests against the safety pin (36).

15. The lock system according claim 10, characterized in that on the safety rod (41), there is a safety transmission lever (42) in order to transmit the movement of a safety slider (43), which is positioned at the underside of the weapon, to the safety rod (41) at the top of the weapon; the safety transmission lever (42) is positioned at a free end (45) of the safety rod (41) and at the underside of the weapon, is supported in articulating fashion on the safety slider (43); and the safety transmission lever (42) is routed around the bolt and/or a cartridge chamber and/or other components or around the bolt travel path and is supported in articulating fashion on the safety slider (43).

16. The lock system according to claim 15, characterized in that the trigger transmission lever (6) and the safety transmission lever (42) are embodied as C-shaped, ring-shaped, bracket-shaped, or question mark-shaped.

17. The lock system according to claim 10, characterized in that the toggle lever arrangement (50) is embodied by means of a hammer lever arm (51) and a guide lever arm (52); the hammer lever arm (51) is an elongated component, one end (53) of which is connected to a hammer bar (4), and at its end (53), the hammer lever arm (51) is able to swivel around a rotation axle (54); the rotation axle (54) cooperates with two cheeks (55), which are positioned at one end of the hammer bar (4) and embrace the end (53) between themselves, and passes through the end (53) so that the hammer lever arm (51) is able to rotate around the axle (54).

18. The lock system according to claim 17, characterized in that at a diametrically opposite end (56) of the hammer lever arm (51), there is an angled hammer surface (57); spaced apart from the end (56) and from the hammer surface (57) toward the end (53), there is a guiding rotation shaft (58), which passes through the hammer lever arm (51) so that the free end (56) of the hammer lever arm, which protrudes beyond the shaft (58) and has the hammer surface, forms the hammer.

19. The lock system according to claim 18, characterized in that the hammer lever arm (51) with the guiding rotation shaft (58) is supported in rotating fashion on the guide lever arm (52); the guide lever arm (52) is a plate-like element with two side surfaces (60, 61), a top (61), a bottom (63), a front end region (64), and a rear end region (65); and an accommodating slot (66) for accommodating the hammer lever arm (51) extends from the rear end region (65) to the front end region (64) over a partial length of the guide lever arm (52).

20. The lock system according to claim 17, characterized in that the hammer lever arm (51) and the guide lever arm (52) compose the toggle lever arrangement (50); the guide lever arm (52) can be pivoted around laterally protruding shaft stubs (69, 70) and the hammer lever arm (51) can be pivoted upward and downward around the shaft (54) and the two are connected to each other by means of the shaft (58); the toggle lever arrangement composed of the hammer lever arm (51) and the guide lever arm (52) is acted on with spring force by means of the hammer bar (4) and a mainspring positioned around it; and the guide lever arm (52) is affixed to the chassis of a firearm by means of shaft stubs (69, 70) when the hammer lever arm (51) and hammer bar (4), by means of a pivoting of the toggle lever arrangement (50), are able to move to a limited degree in a direction opposite from a direction of fire.

21. The lock system according to claim 17, characterized in that a recess is provided in the underside (63) of the guide lever arm (52), extending from the front side (64); the recess is embodied so that it extends into the guide lever arm (52); the recess (75) has a recess roof (76) at the top (62); the recess roof (76) has a front region (77) and a rear region (78); and the front region (77) and rear region (78) are embodied so that the recess roof (76) has a front recess roof region (77) and a rear recess roof region (78), which are embodied as inclined relative to each other at an angle, in particular at an angle of 25° to 50°.

22. The lock system according to claim 21, characterized in that a safety rod (85) is provided for pivoting the guide lever arm (52) and for activating and deactivating the safety; at one end, the safety rod (85) has a control bead (95); and the bead (95) is embodied so that it cooperates with the recess (75) and the recess roof (76) in a corresponding fashion.

23. The lock system according to claim 20, characterized in that the toggle lever arrangement (50) composed of the hammer lever arms (51) and guide lever arms (52) is in an activated-safety position when the shaft (58) is positioned above the shaft stubs (69, 70) and is in a deactivated-safety, ready-to-fire position when the shaft (58) or its rotation axis is positioned below the shaft stubs (69, 70) or their rotation axis, and is in a fired position when the rotation shaft or guiding rotation shaft (58) is positioned partially below or entirely below the shaft stubs (69, 70) as a result of which, the hammer bar is positioned the farthest forward in the direction of fire.

* * * * *